US010343445B2

(12) United States Patent
Wu

(10) Patent No.: US 10,343,445 B2
(45) Date of Patent: Jul. 9, 2019

(54) RETRACTABLE PEN

(71) Applicant: Chien Ming Wu, Taoyuan (TW)

(72) Inventor: Chien Ming Wu, Taoyuan (TW)

( * ) Notice: Subject to any disclaimer, the term of this patent is extended or adjusted under 35 U.S.C. 154(b) by 160 days.

(21) Appl. No.: 15/660,937

(22) Filed: Jul. 26, 2017

(65) Prior Publication Data

US 2018/0056705 A1 Mar. 1, 2018

(30) Foreign Application Priority Data

Aug. 24, 2016 (TW) ..... 105126981 A

(51) Int. Cl.
*B43K 24/08* (2006.01)
*B43K 7/12* (2006.01)

(52) U.S. Cl.
CPC ..... *B43K 7/12* (2013.01); *B43K 24/08* (2013.01); *B43K 24/084* (2013.01)

(58) Field of Classification Search
CPC ..... B43K 7/12; B43K 24/08; B43K 24/084; B43K 24/00; B43K 24/02; B43K 24/023; B43K 24/06; B43K 24/026; B43K 24/082; B43K 24/086
See application file for complete search history.

(56) References Cited

U.S. PATENT DOCUMENTS 3,133,526 A * 5/1964 Sears ..... B43K 7/02 401/110
3,419,336 A * 12/1968 Kirk ..... B43K 7/12 401/111
6,257,787 B1 * 7/2001 Kirk ..... B43K 7/00 401/104
7,059,796 B2 * 6/2006 Lewis, Jr. ..... B43K 5/17 401/107

* cited by examiner

*Primary Examiner* — David J Walczak
(74) *Attorney, Agent, or Firm* — Rabin & Berdo, P.C.

(57) ABSTRACT

A retractable pen includes a barrel, an ink cartridge, a limiting member, a shifting member and a deformable member. When the shifting member is moved relative to the limiting member between a first position and a third position, the ink cartridge can be moved from a retracted position to an extended position or from the extended position to the retracted position. When the ink cartridge is located at the extended position, the deformable member can be further compressed by between the shifting member and the ink cartridge, allowing the shifting member to be moved further from the third position to a second position closer to the ink cartridge. When the shifting member is located at the second position, the ink cartridge is continuously held to the extended position and pressed against a lead-out opening of the barrel without the risk of swaying when a user writes with the retractable pen.

15 Claims, 25 Drawing Sheets

RETRACTABLE PEN

FIELD OF THE INVENTION

The present invention relates to a pen, and more particularly to a retractable pen including an ink cartridge having a tip that, when being moved to an extended position for writing, is continuously pressed against a lead-out opening of the pen without the risk of swaying during the whole course of writing.

BACKGROUND OF THE INVENTION

A ball pen is a writing instrument. Ink filled in an ink cartridge received in a barrel of the ball pen flows to a metal ball at a tip of the pen under the action of atmospheric pressure and gravity of ink. The metal ball rotates when the ball pen is used to write on paper, and ink is transferred from the rotating metal ball to the paper to form handwriting strokes. Currently, click ball pens are very common in the market. By clicking downward on the top of the ball pen, the tip of the ink cartridge is extended from a bottom opening of the barrel or retracted into the barrel.

To allow the tip of the ink cartridge to project from the bottom opening of the barrel, the bottom opening of the barrel has a size slightly larger than a diameter of the ink cartridge. When the tip of the ink cartridge is forward extended from the barrel, there is a clearance formed between the ink cartridge and the bottom opening of the barrel. Due to the clearance, the tip of the ink cartridge extended from the barrel tends to incline while pressing against the bottom opening of the barrel. The inclined tip would possibly cause the forming of undesired handwriting strokes when using the click ball pen to write.

In view of the above disadvantage of the currently available ball pens, it is desirable to develop an improved ball pen, so that the tip of the ink cartridge extended from the bottom opening of the barrel can be continuously pressed against the bottom opening without inclining or swaying during the process of writing with the ball pen.

SUMMARY OF THE INVENTION

A primary object of the present invention is to provide a retractable pen, which includes an ink cartridge having a tip that, when being moved to an extended position for writing, is continuously pressed against a lead-out opening of the pen without the risk of swaying during the whole course of writing.

To achieve the above and other objects, the retractable pen according to the present invention includes a body and a switching device. The body includes a barrel and an ink cartridge received in the barrel. The barrel has a lower end forming a lead-out opening, and the ink cartridge has a lower end forming a tip, which has an outer diameter larger than an inner diameter of the lead-out opening.

The switching device is mounted between the barrel and the ink cartridge for causing the tip to move between an extended position, in which the tip is projected from the lead-out opening of the barrel, and a retracted position, in which the tip is located in the barrel. Since the lead-out opening of the barrel has an inner diameter smaller than the outer diameter of the tip, the tip moved to the extended position is pressed against and immovably held to the lead-out opening.

According to a preferred embodiment, the switching device includes a limiting member, a shifting member, a resetting member and a deformable member. The limiting member is fitted in the barrel and formed with a plurality of first stop points for limiting the tip to the retracted position continuously, a plurality of second stop points for limiting the top to the extended position continuously, and a shifting path defined between any two adjacent first and second stop points. The first stop points have a horizontal height higher than that of the second stop points. The shifting member is mounted in the limiting member and movable from one first stop point to an adjacent second stop point or from one second stop point to an adjacent first stop point. When the shifting member is shifted along the shifting path from the first stop point to the adjacent second stop point, the shifting member is moved from a first position farther away from an upper end of the ink cartridge to a second position closer to the upper end of the ink cartridge for pushing against the ink cartridge.

The resetting member can elastically bring the tip from the extended position to the retracted position. The deformable member is mounted between the shifting member and the ink cartridge. When the tip is located at the extended position and the shifting member is located at a third position within the shifting path before being moved to the second position, the deformable member can be compressed and deformed by between the shifting member and the ink cartridge, allowing the shifting member to be further moved from the third position to the second position According to the above preferred embodiment, the limiting member further includes a first guide-in point located below each of the first stop points and a second guide-in point located below each of the second stop points; and the shifting member located at the third position has a height position higher than both of the first and the second guide-in points. The limiting member further includes a first contact surface located between each of the first stop points and its corresponding first guide-in point, and the shifting member is moved from the first guide-in point to the first stop point via the first contact surface. Also, the limiting member further includes a second contact surface located between each of the second stop points and its corresponding second guide-in point, and the shifting member is moved from the second guide-in point to the second stop point via the second contact surface. The first contact surfaces and the second contact surfaces are extended in two nonparallel directions; an included angle between each of the first contact surfaces and a horizontal plane is a blunt angle; and an included angle between each of the second contact surfaces and the horizontal plane is also a blunt angle.

The limiting member further includes a plurality of guide sections correspondingly located below the first guide-in points and the second guide-in points, such that the shifting member is moved from one first stop point to an adjacent second stop point or from one second stop point to an adjacent first stop point via one corresponding guide section. Each of the guide sections includes a first end and an opposite second end located at a horizontal height lower than that of the first end. One of two adjacent first and second ends is longitudinally located corresponding to one first contact surface while the other one of the two adjacent first and second ends is longitudinally located corresponding to one second contact surface located adjacent to that first contact surface.

Each of the guide sections further includes a guiding surface extended between the first end and the second end. The shifting member is moved from the first end to the second end via the guiding surface. The guiding surfaces are extended in a direction nonparallel to the first contact surfaces and the second contact surfaces; and an included angle between each of the guiding surfaces and a horizontal plane is a sharp angle. The shifting member in the course of moving from the third position to the second position is pressed against the guiding surfaces and moved in a circular motion.

According to the above embodiment, the shifting member having been moved along the shifting path to the second position is movable from the second position back to the first position by an elastic restoring force of the resetting member, so as to press against the first stop point or the second stop point.

The shifting member includes a lower slide block, an upper slide block and a shifting plate located between the lower and the upper slide block, such that the lower slide block and the shifting plate are brought by the upper slide block to move. The lower slide block includes a first body portion and a second body portion formed on a top of the first body portion; and the deformable member has an end pressing against the first body portion. The limiting member is internally formed with a radially inward extended abutting seat; and the resetting member has an end pressing against the abutting seat and another end pressing against the second body portion of the shifting member. When the tip is moved from the retracted position to the extended position, the resetting member is compressed by between the abutting seat and the second body portion to have a shortened length.

According to another preferred embodiment of the present invention, the shifting path is a straight line and the second stop point is located immediately below the corresponding first stop point; and the shifting member includes an elastic arm, which is directly pressed against the second stop point and the first stop point when the shifting member is located at the second position and the first position, respectively. Further, the ink cartridge is formed with a radially outward extended compression flange and the barrel is formed in the lead-out opening with a plurality of circumferentially spaced compression bosses; and the resetting member has an end pressing against the compression flange and another end pressing against the compression bosses.

According to the above two embodiments, the shifting member located at the first position is pressed against the first stop point or the second stop point; and the shifting member located at the third position has a height position higher than or the same as that of the second stop points.

In another preferred embodiment, the limiting member is provided with a first limiting rail corresponding to the shifting path and the shifting member is assembled to the first limiting rail. Whereby when the shifting member is moved along the first limiting rail from the second stop point to the first stop point, the shifting member is pressed against a wall surface of the first limiting rail and moved in a circular motion.

In the above embodiment, the first limiting rail includes a first rail section and a second rail section angularly extended from an end of the first rail section, such that the shifting member being moved from the first stop point to the adjacent second stop point or from the second stop point to the adjacent first stop point is pressed against the first rail section and the second rail section to move to the second position in two shifting directions. Further, since the first and the second rail section are obliquely extended in two different directions, the shifting member moving along the first and the second rail section is caused to move in a circular motion.

In the above embodiment, the limiting member includes a rotational housing and a stationary housing. The stationary housing is fixedly connected to the barrel while the rotational housing is rotatably connected to the stationary housing for driving the shifting member to rotate. The above-mentioned first limiting rail is provided on the stationary housing. The rotational housing can be turned to change its position relative to the stationary housing and bring the shifting member to move from the first position to the second position.

In a further preferred embodiment of the present invention, the shifting member includes a locating block, which is extended through the first limiting rail to project from the stationary housing and form a projected section; and the first rail section is located perpendicular to the second rail section while the second rail section is extended horizontally. When the shifting member is moved from the first position toward the second position, it is first moved along the first rail section in a linear motion and then moved into the second rail section in a circular motion.

In a still further embodiment of the present invention, the limiting member includes a stationary housing and a rotational housing rotatably connected to the stationary housing. The rotational housing is formed with the first limiting rail and is rotatable, and the stationary housing is formed with a second limiting rail intersecting with the first limiting rail. The locating block of the shifting member is extended through the second limiting rail into the first limiting rail. The rotational housing can be turned to change a position of it relative to the stationary housing, such that the shifting member can be moved from the first position to the second position or from the second position to the first position while the locating block is engaged with both of the first and the second limiting rail.

In all of the above four embodiments, when the deformable member is compressed by between the ink cartridge and the shifting member, it is shortened by a compression length, which is equal to a longitudinal straight-line distance from the third position to the second position. Meanwhile, a distance by which the tip is moved from the retracted position to the extended position is equal to a longitudinal straight-line distance from the first position to the third position.

The present invention is characterized in that the tip located at the extended position is pressed against and held to the lead-out opening of the barrel, and that the deformable member compressed and deformed by between the ink cartridge and the shifting member allows the shifting member to be moved from the third position to the second position when the tip has been held to the lead-out opening and can not be moved any further. When the shifting member is located at the second position, the locating block thereof is pressed against the second stop point and the tip is continuously pressed against and held to the lead-out opening of the barrel without the risk of swaying when a user writes with the retractable pen. With these arrangements, the probability of making errors in handwriting can be reduced.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
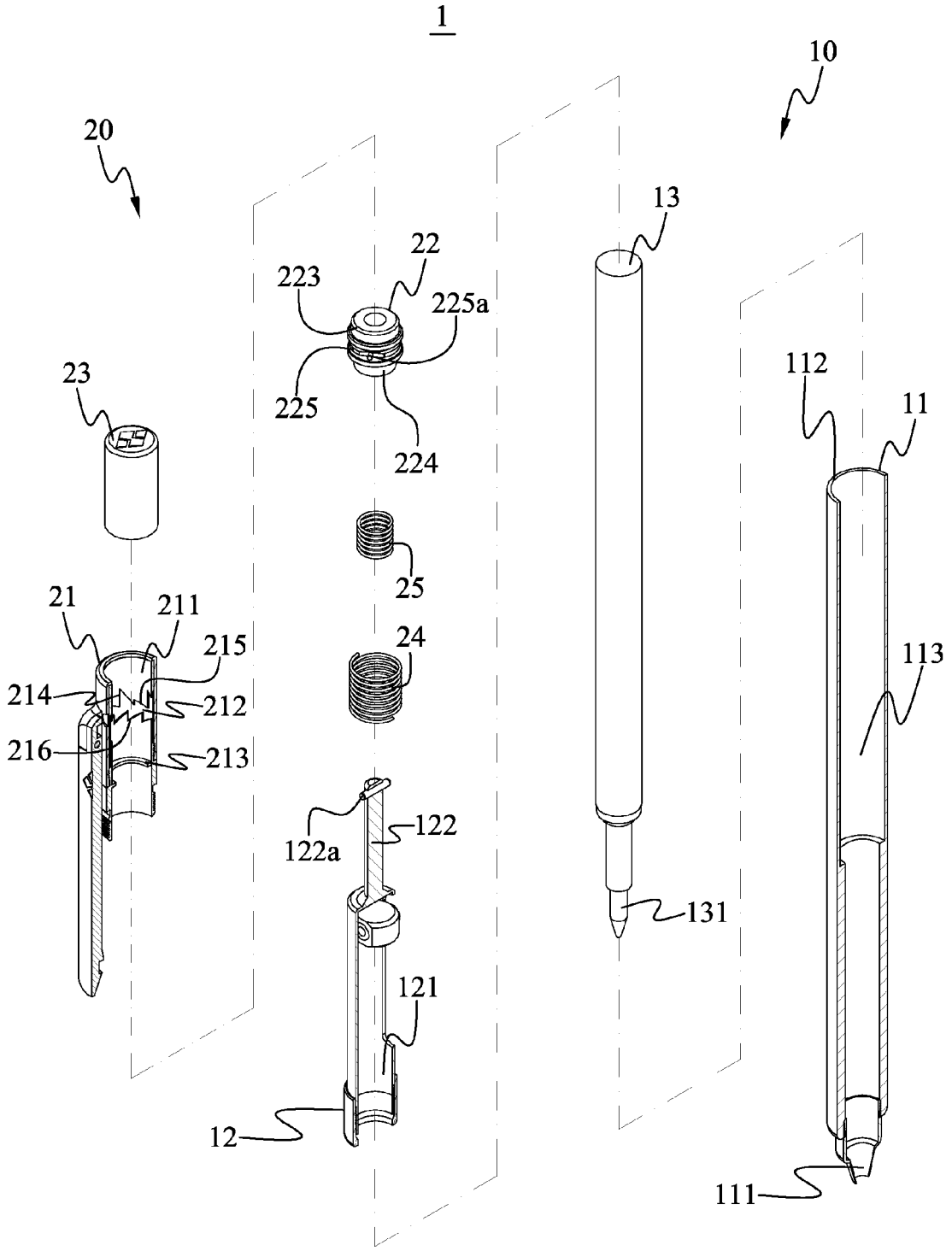
FIG. 1 is an exploded perspective and partially cutaway view of a retractable pen according to a first preferred embodiment of the present invention.

The present invention will now be described with some preferred embodiments thereof and by referring to the accompanying drawings. For the purpose of easy to understand, elements that are the same in the preferred embodiments are denoted by the same reference numerals.

Figure 2:
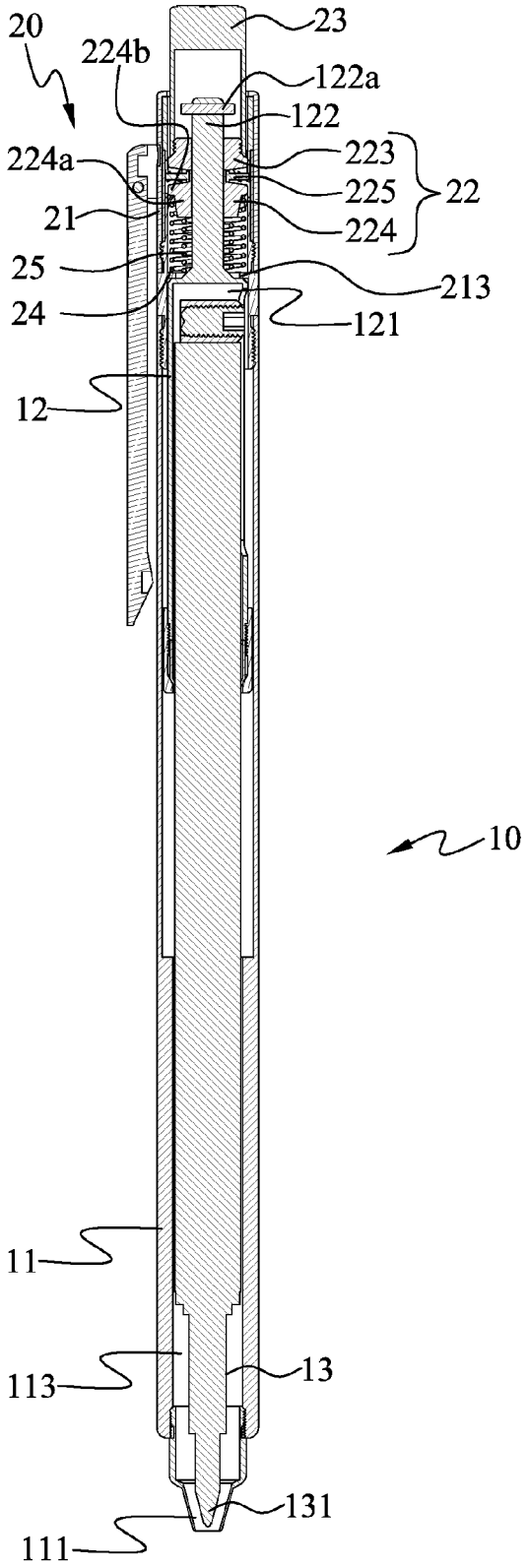
FIG. 2 is an assembled longitudinal sectional view of the retractable pen of FIG. 1.

Please refer to FIGS. 1 and 2. A retractable pen 1 according to a first preferred embodiment of the present invention includes a body 10 and a switching device 20. The body 10 includes a cylindrical barrel 11, which has a lower end forming a forward tapered lead-out opening 111 and an upper end forming a round lead-in opening 112 and internally defines a receiving space 113 between the lead-out opening 111 and the lead-in opening 112. In the receiving space 113, there are mounted a clamping member 12 and an ink cartridge 13. The clamping member 12 has a lower part internally defining an assembling space 121 and an upper part forming an assembling stem 122, which is upward projected from the lead-in opening 112. The ink cartridge 13 has an upper end assembled into the assembling space 121 of the clamping member 12 and a lower end connected to a forward tapered tip 131, which has an outer diameter larger than an inner diameter of the lead-out opening 111. The assembling stem 122 of the clamping member 12 has an upper end provided with a horizontally protruded abutting section 122*a*. Both of the clamping member 12 and the ink cartridge 13 are linearly movable upward and downward in the receiving space 113 of the barrel 11, such that the tip 131 on the ink cartridge 13 is movable between a retracted position 131*a*, in which the tip 131 is located in the receiving space 113 as shown in FIG. 4B, and an extended position 131*b*, in which the tip 131 is projected beyond the receiving space 113 as shown in FIG. 4G. Further, when the tip 131 is located at the extended position 131*b*, the tip 131 having an outer diameter larger than the inner diameter of the lead-out opening 111 is pressed against and accordingly, immovably held to the lead-out opening 111, such that a partial length of the tip 131 is projected from the lead-out opening 111 while the rest part of the tip 131 is located in the receiving space 113 of the barrel 11.

The switching device 20 is mounted between the barrel 11 and the ink cartridge 13, and includes a stationary limiting member 21, a movable shifting member 22, a push member 23, which is movable when being pushed, a resetting member 24, which can be compressed to change a distance between two ends thereof, and a deformable member 25, which is deformable when being compressed. The limiting member 21 internally defines a holding space 211, which is communicable with an upper and a lower open end of the limiting member 21, and is screwed into the lead-in opening 112 of the barrel 11, such that the holding space 211 is communicable with the receiving space 113 in the barrel 11 and the assembling stem 122 of the clamping member 12 is located in the holding space 211.

Figure 3:
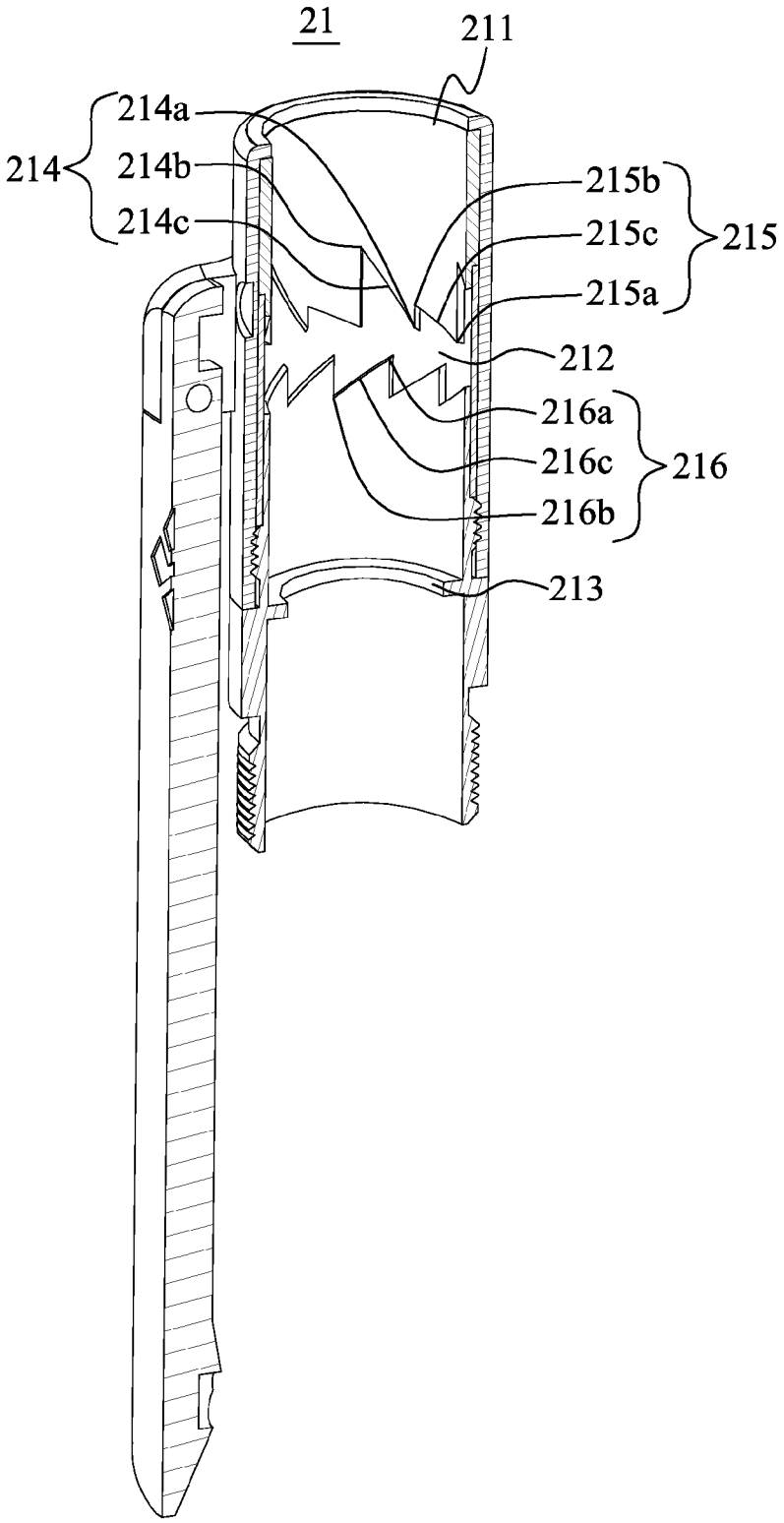
FIG. 3 is a cutaway view of a limiting member of the retractable pen according to the first preferred embodiment of the present invention.

Please refer to FIGS. 1 and 3. The limiting member 21 is internally formed with a circumferentially extended groove to serve as a shifting rail 212, which is communicable with the holding space 211 in the limiting member 21. The limiting member 21 is also internally formed with a circumferentially extended rib to serve as an abutting seat 213. The shifting rail 212 is provided along one side, which is an upper side in FIGS. 1 and 3, with a plurality of upward dented and equally spaced first locating spaces 214. Further, an upward dented second locating space 215 is formed between any two adjacent first locating spaces 214. It is noted the second locating space 215 has a volume smaller than that of the first locating space 214. Meanwhile, the shifting rail 212 is provided along another side, which is a lower side in FIGS. 1 and 3, with a plurality of equally spaced guiding sections 216.

As shown, each of the first locating spaces 214 has a first guide-in point 214*a* and an opposite first stop point 214*b*. The first guide-in point 214*a* is located at a horizontal position lower than that of the first stop point 214*b*, and a slant first contact surface 214*c* is extended between the first guide-in point 214*a* and the first stop point 214*b*. Similarly, each of the second locating spaces 215 has a second guide-in point 215*a* and an opposite second stop point 215*b*. The second guide-in point 215*a* is located at the same horizontal position as the first guide-in point 214*a*, the second stop point 215*b* is located at a horizontal position lower than that of the first stop point 214*b*, and a slant second contact surface 215*c* is extended between the second guide-in point 215*a* and the second stop point 215*b*. As can be seen in FIG. 4C, a shifting path 217 is defined between the first stop point 214*b* and the second stop point 215*b* of two adjacent first locating space 214 and second locating space 215; the first contact surfaces 214*c* and the second contact surfaces 215*c* are extended in two nonparallel directions; an included angle between each of the first contact surfaces 214*c* and a horizontal plane 30 is a blunt angle A1; and an included angle between each of the second contact surfaces 215*c* and the horizontal plane 30 is also a blunt angle A1.

The guiding sections 216 are correspondingly located below the first guide-in points 214*a* and the second guide-in points 215*a*. Each of the guiding sections 216 has a first end 216*a* and an opposite second end 216*b*, which are located at different horizontal heights. More specifically, as can be seen in FIG. 4C, the first ends 216*a* are located at a horizontal position higher than that of the second ends 216*b*, and a slant guiding surface 216*c* is extended between the first end 216*a* and the second end 216*b* of each guiding section 216. It is noted one of the first end 216*a* and the second end 216*b* of each guiding section 216 is located longitudinally corresponding to one first contact surface 214*c*, while the other one of the first end 216*a* and the second end 216*b* is located longitudinally corresponding to one second contact surface 215*c* located adjacent to that first contact surface 214*c*. Further, the guiding surfaces 216*c* are extended in a direction nonparallel to the first contact surfaces 214*c* and the second contact surfaces 215*c*, and an included angle between each guiding surface 216*c* and the horizontal plane 30 is a sharp angle A2. Since the included angles between the first/second contact surfaces 214*c*, 215*c* and the horizontal plane 30 are blunt angles A1 while the included angles between the guiding surfaces 216*c* and the horizontal plane 30 are sharp angles A2, the first contact surfaces 214*c* and the second contact surfaces 215*c* are inclined in directions different from the inclination direction of the guiding surfaces 216*c*.

Figure 4A:
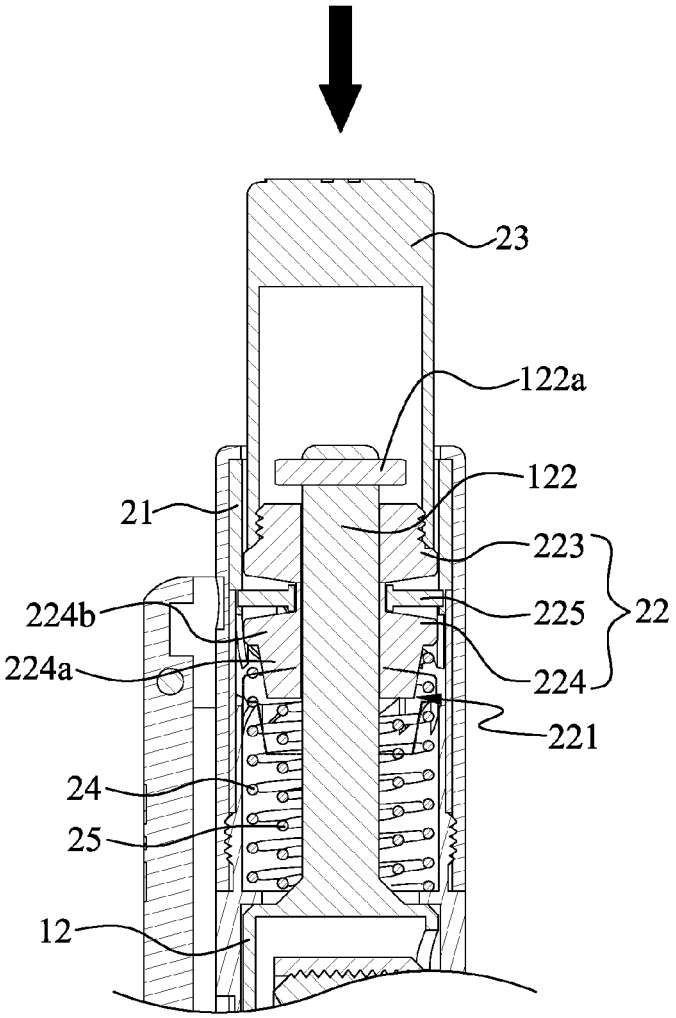
FIGS. 4A to 4H are sectional views showing a tip of the retractable pen of FIG. 1 is shifted from a retracted position to an extended position.
Figure 4B:
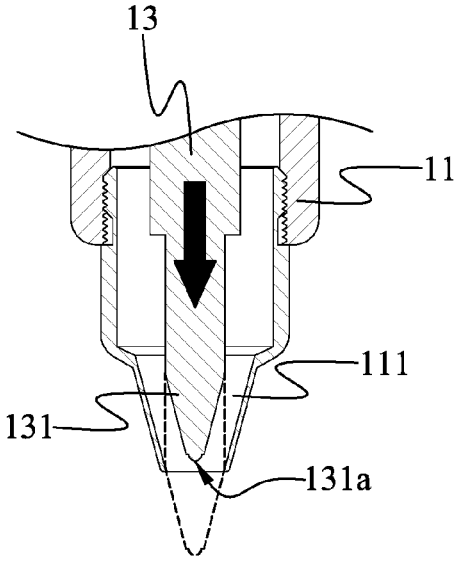
Figure 4C:
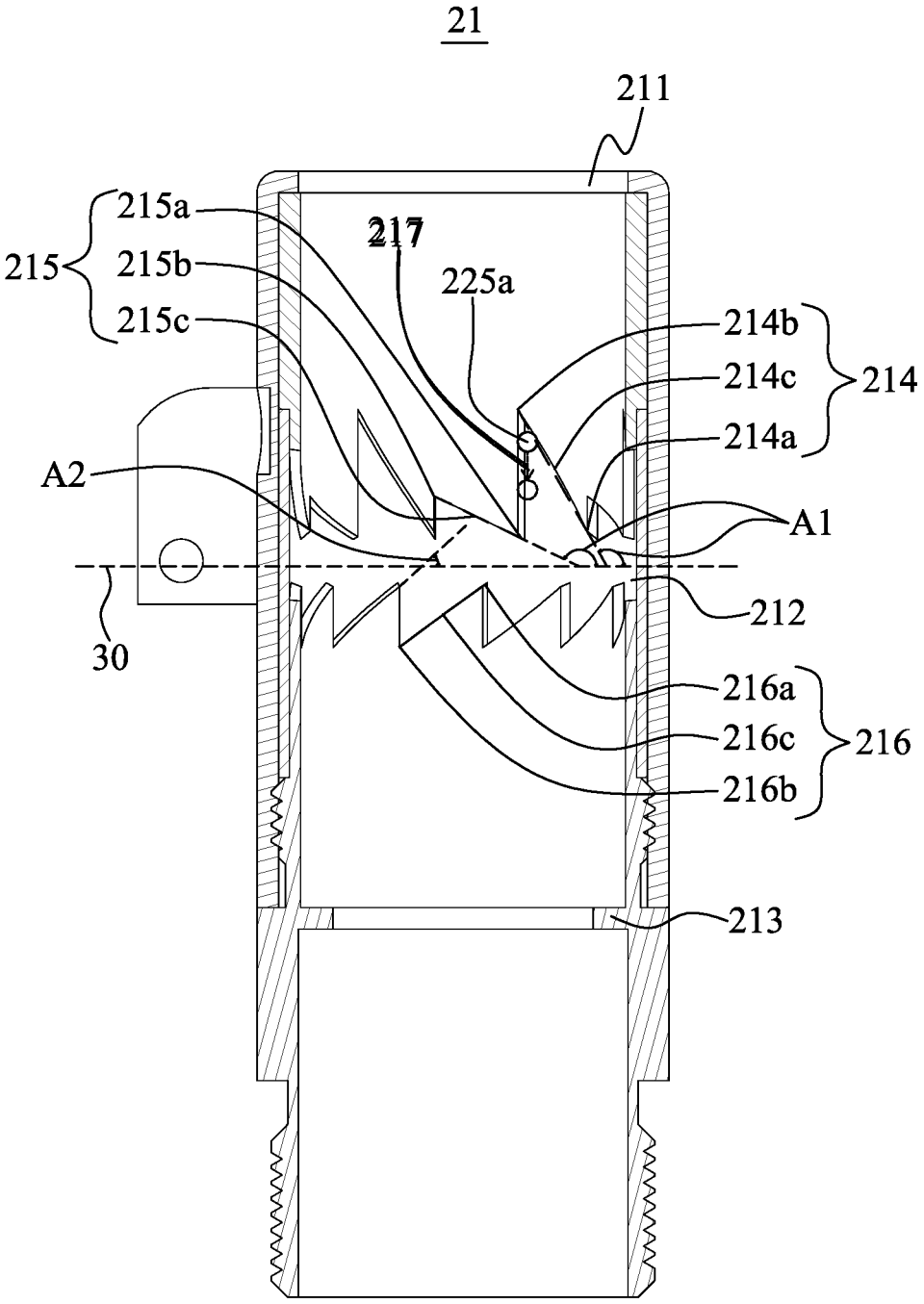
Figure 4D:
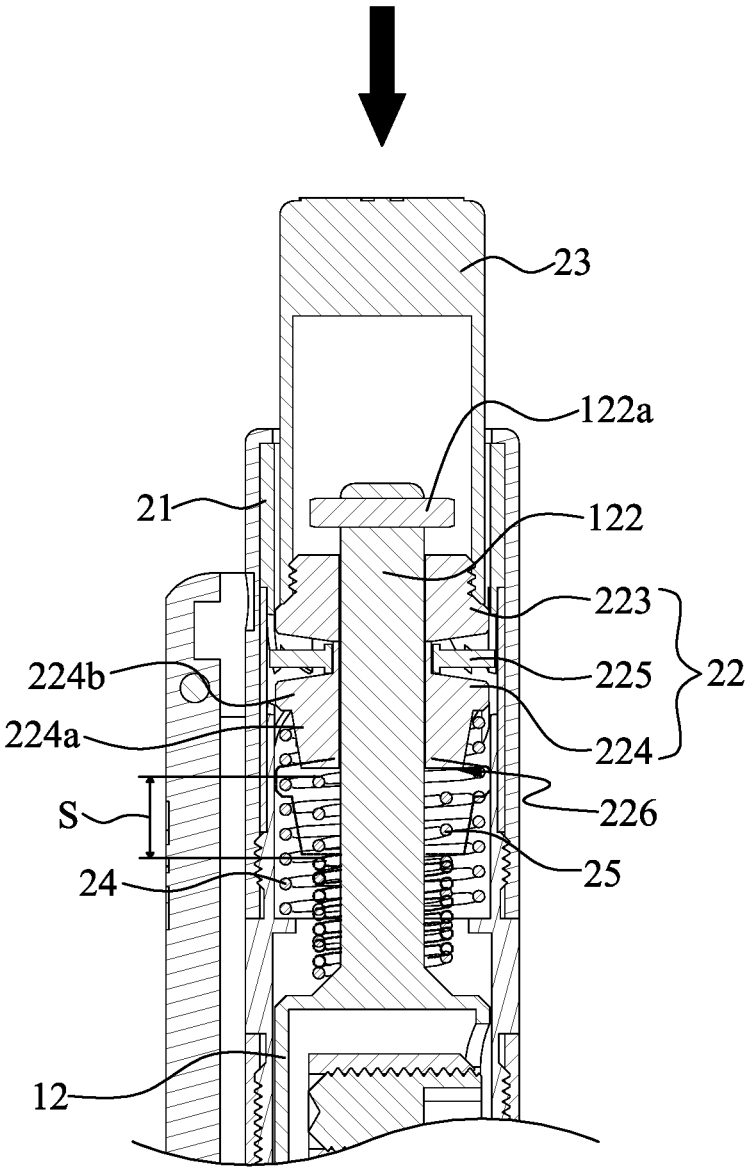
Figure 4E:
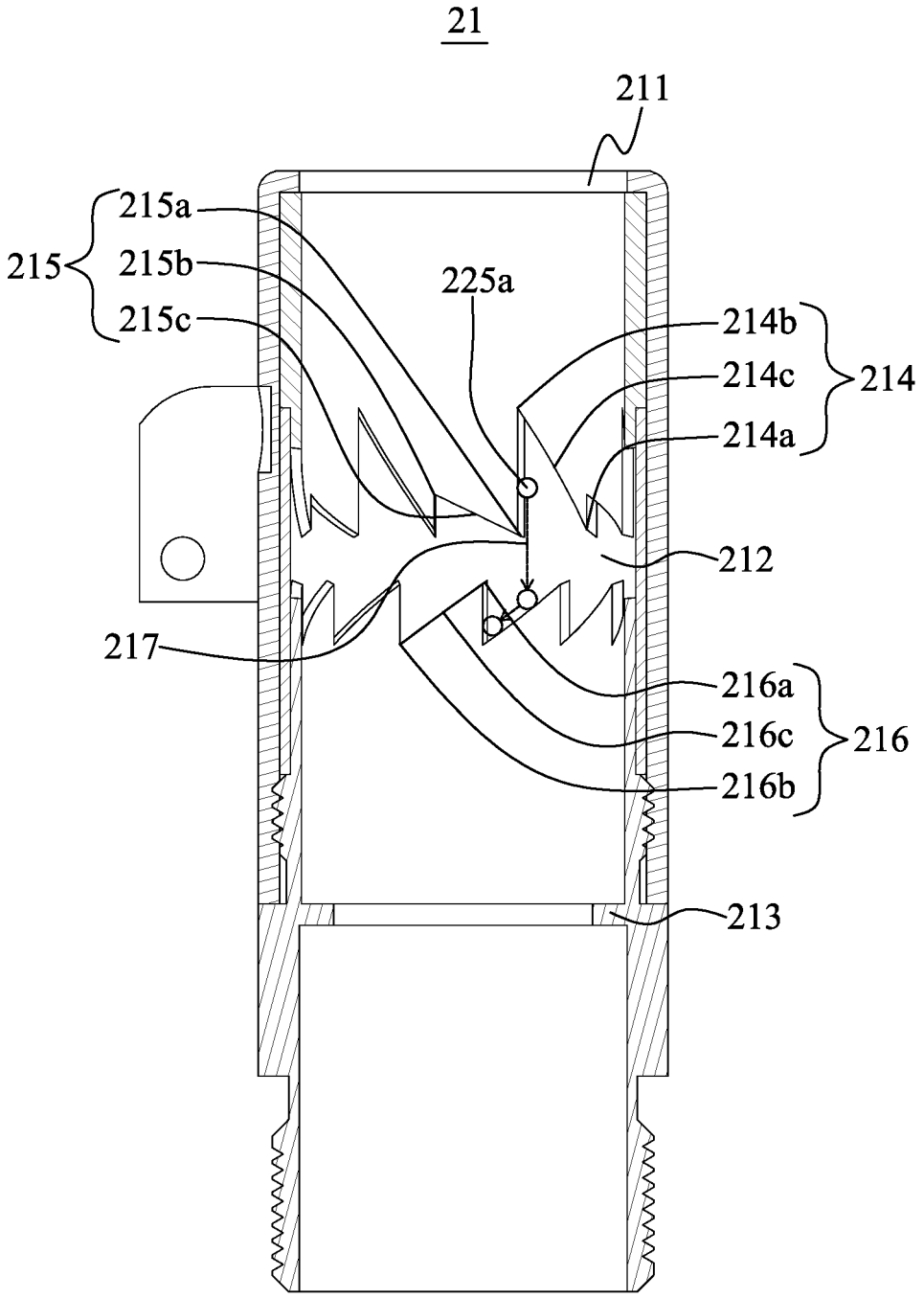
Figure 4F:
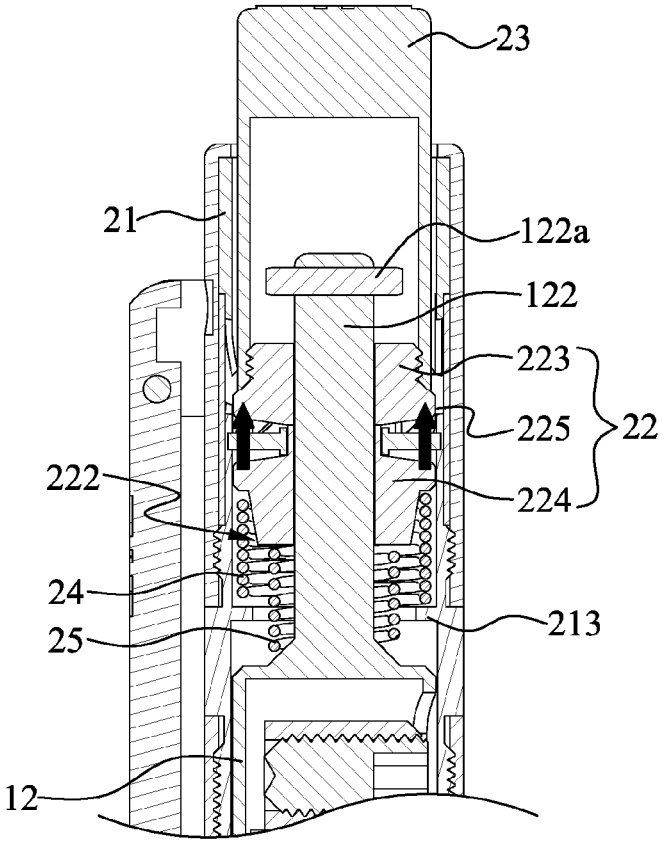
Figure 4G:
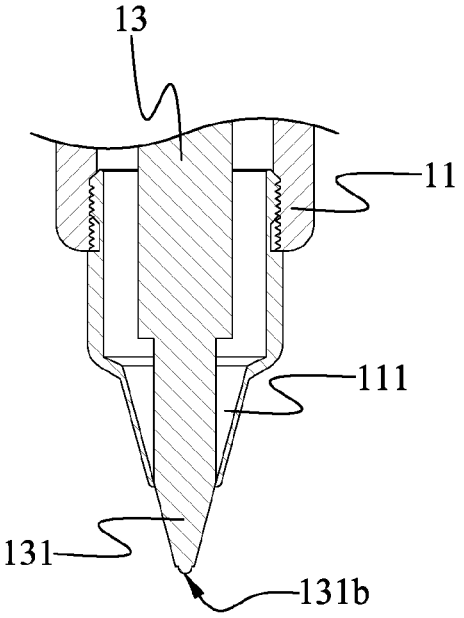

Please refer to FIGS. 1 and 2 along with FIGS. 4A and 4F. The shifting member 22 is located in the holding space 211 of the limiting member 21 and is fitted around the assembling stem 122 of the clamping member 12, such that the shifting member 22 can be moved along the shifting path 217 downward and upward between a first position 221 farther away from the upper end of the ink cartridge 13 (see FIG. 4A) and a second position 222 closer to the upper end of the ink cartridge 13 (see FIG. 4F) to thereby change a relative position between the shifting member 22 and the limiting member 21. The shifting member 22 is located below the abutting section 122*a* and mainly includes an upper slide block 223, a lower slide block 224 and a shifting plate 225. The upper slide block 223 is located above the lower slide block 224. The shifting plate 225 is located between the upper slide block 223 and the lower slide block 224 and has a locating block 225*a* extended into the shifting rail 212. The lower slide block 224 includes a first body portion 224*a* and a second body portion 224*b* formed on a top of the first body portion 224*a*. In the illustrated first preferred embodiment, the shifting member 22 is movable in the holding space 211, so that the upper slide block 223 can selectively press against the abutting section 122*a* and the locating block 225*a* can move downward from the first stop point 214*b* of one first locating space 214 to press against the guiding surface 216*c* of one corresponding guiding section 216 and then move upward to the second stop point 215*b* of an adjacent second locating space 215. Or, the locating block 225*a* can move downward from the second stop point 215*b* of one second locating space 215 to press against the guiding surface 216*c* of one corresponding guiding section 216 and then move upward to the first stop point 214*b* of an adjacent first locating space 214. Regarding the push member 23, it is screwed onto the upper slide block 223 of the shifting member 22.

The resetting member 24 is located in the holding space 211 of the limiting member 21 with an end upward pressing against the second body portion 224*b* of the lower slide block 224 and another end downward pressing against the abutting seat 213 in the limiting member 21. The resetting member 24 is able to upward push against the shifting member 22, so that the locating block 225*a* of the shifting member 22 is continuously pressed against the first stop point 214*b* of one first locating space 214 or the second stop point 215*b* of one second locating space 215. As can be seen in FIGS. 1 and 3, the deformable member 25 is located inside the resetting member 24 with an end upward pressing against the first body portion 224*a* of the lower slide block 224 and another end downward pressing against the clamping member 12. In the illustrated first preferred embodiment, the resetting member 24 can be a spring or formed of two magnets, and the deformable member 25 can be a spring.

Referring to FIGS. 4A to 4C. To use the retractable pen 1, first push the push member 23 downward for the shifting member 22 to move along the shifting path 217 toward the second position 222. Meanwhile, the locating block 225*a* is brought to move from the first stop point 214*b* of the first locating space 214 toward the guiding surface 216*c* of the guiding section 216. While the shifting member 22 is moved from the first position 221 toward the second position 222, the ink cartridge 13 is brought by the deformable member 25 and the clamping member 12 to move toward the lead-out opening 111, such that the tip 131 is moved from the retracted position 131*a* to the extended position 131*b*. At this point, the lower slide block 224 of the shifting member 22 and the abutting seat 213 together compress the resetting member 24 between them, so that a distance between two ends of the resetting member 24 is shortened.

When the tip 131 is located at the extended position 131*b*, the shifting member 22 is also located at a third position 226 within the shifting path 217. More specifically, when the shifting member 22 shifts along the shifting path 217 to move from the first position 221 to the third position 226, a longitudinal straight-line distance from the first position 221 to the third position 226 is equal to a straight-line distance by which the tip 131 is moved from the retracted position 131*a* to the extended position 131*b*. Further, when the shifting member 22 is located at the third position 226, the locating block 225*a* is located at a height position higher than the second stop point 215*b* of the second locating space 215. However, it is understood the above-described height position of the locating block 225*a* at the time the shifting member 22 is located at the third position 226 is only illustrative to facilitate easy explanation of the present invention. That is, the locating block 225*a* can be otherwise located at a height position the same as that of the second stop points 215*b* of the second locating spaces 215 when the shifting member 22 is located at the third position 226.

Referring to FIGS. 4D and 4E. When the tip 131 is located at the extended position 131*b*, it is pressed against the lead-out opening 111 and stops the clamping member 12 and the ink cartridge 13 from moving downward any further. However, since the deformable member 25 located between the shifting member 22 and the clamping member 12 is deformable, the shifting member 22 can still be moved downward along the shifting path 217 to the second position 222. When the shifting member 22 keeps moving toward the second position 222, the deformable member 25 is compressed by between the first body portion 224*a* of the lower slide block 224 and the clamping member 12 and is accordingly, shortened by a compression length S. The compression length S is equal to a longitudinal straight-line distance from the third position 226 to the second position 222. While the shifting member 22 is moving from the third position 226 to the second position 222, the locating block 225*a* is moved downward to press against and shift along the guiding surface 216*c* to the second end 216*b*. With the locating block 225*a* pressed against the guiding surface 216*c*, the shifting plate 225 is moved in a circular motion.

Figure 4H:
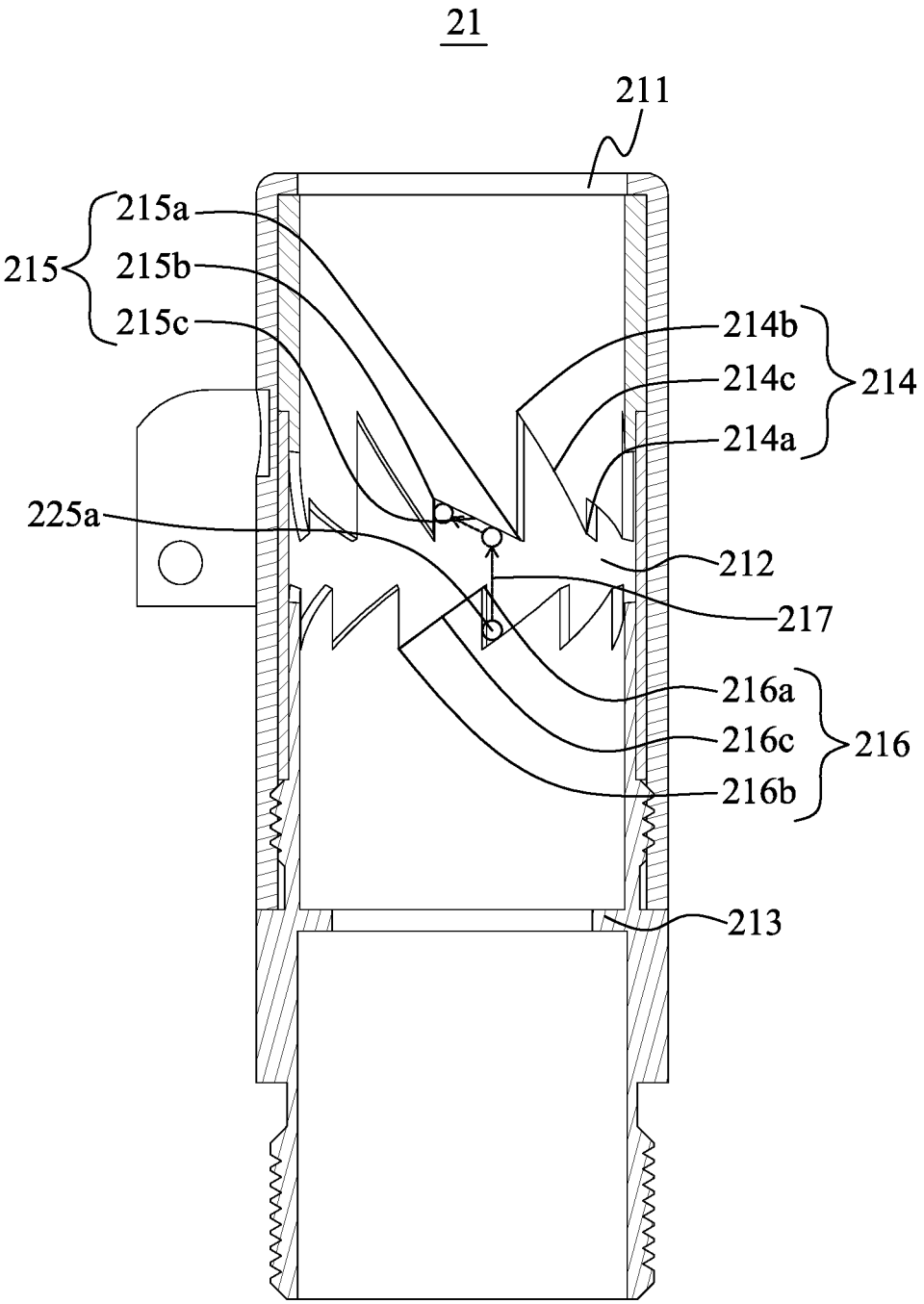

Referring to FIGS. 4F to 4H. When the locating block 225*a* is located at the second end 216*b* and the push member 23 is released, the resetting member 24 automatically pushes the shifting member 22 upward, so that the shifting member 22 is longitudinally moved upward from the second position 222 to the first position 221 and the locating block 225*a* is moved from the second end 216*b* of the guiding section 216 to the first contact surface 214*c* of the first locating space 214. Then, the locating block 225*a* is moved along the first contact surface 214*c* toward the second stop point 215*b* and kept pressing against the second stop point 215*b* of the second locating space 215 under the elastic restoring force of the resetting member 24. Whereby, when the locating block 225*a* is pressed against the second stop point 215*b*, the locating block 225*a* is located at a horizontal position lower than the third position 226. With the locating block 225*a* being continuously pressed against the second stop point 215*b* of the second locating space 215, the tip 131 is continuously held to the extended position 131*b* for a user to write with the retractable pen 1. Moreover, since the tip 131 of the ink cartridge 13 is pressed against the lead-out opening 111 without the risk of shaking, the probability of making errors in handwriting can be reduced.

Figure 5A:
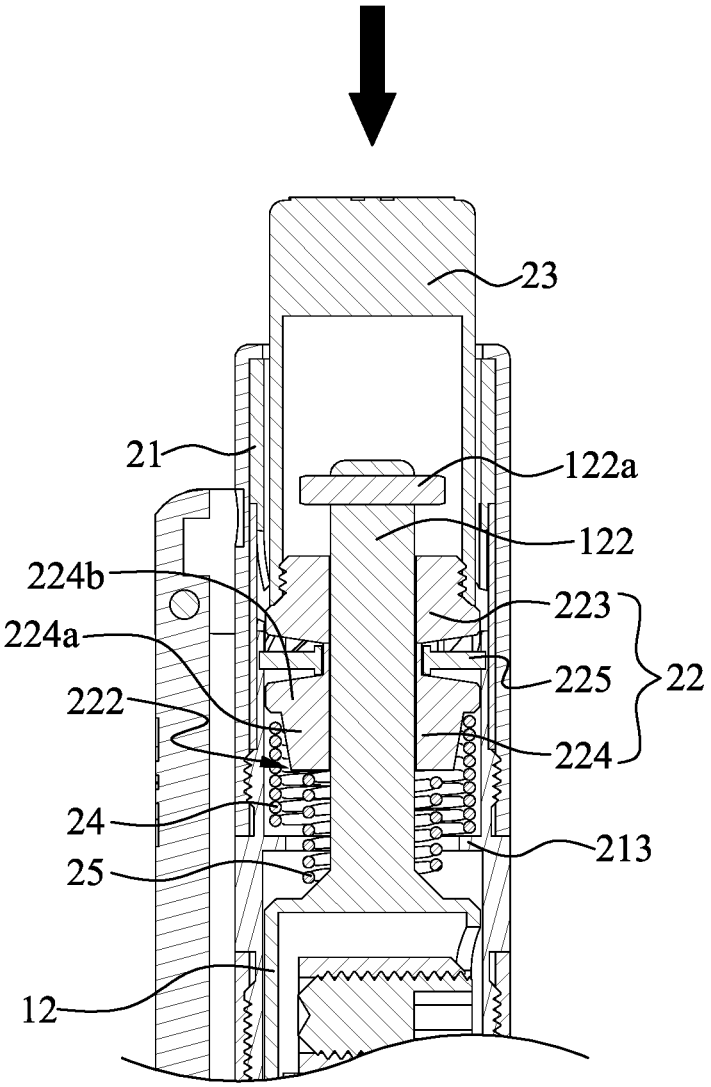
FIGS. 5A to 5E are sectional views showing the tip of the retractable pen of FIG. 1 is shifted from the extended position to the retracted position.
Figure 5B:
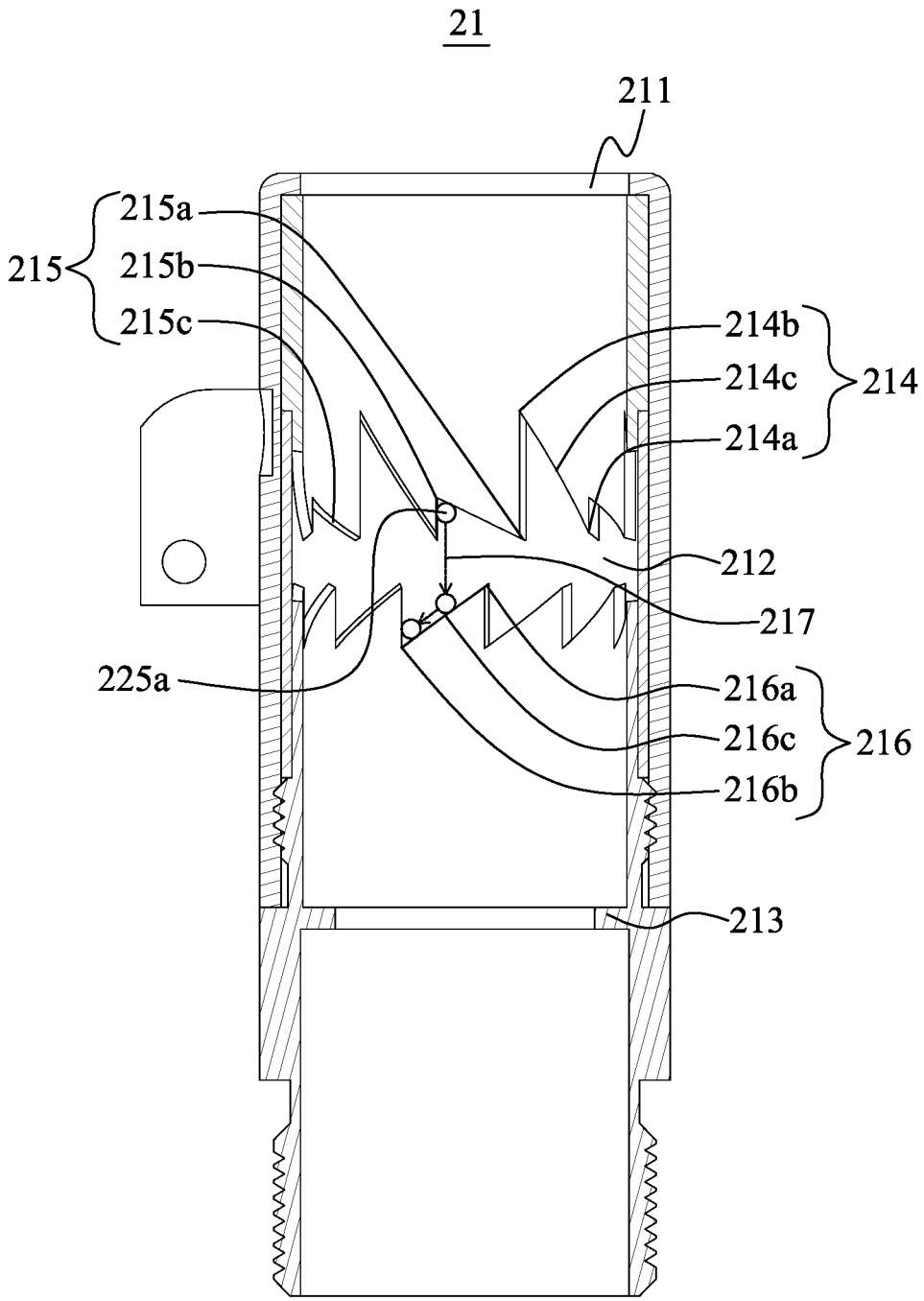

Referring to FIGS. 5A and 5B. When the user has completed writing, the user can simply push the push member 23 again for the same to move the shifting member 22 along the assembling stem 122 from the first position 221 down to the second position 222. At this point, the locating block 225*a* is moved from the second stop point 215*b* of the second locating space 215 toward the guiding surface 216*c* of the guiding section 216, but the clamping member 12 and the ink cartridge 13 are not movable because the tip 131 is immovably pressed against the lead-out opening 111. When the locating block 225*a* has been moved downward to press against the guiding surface 216*c*, it will shift along the guiding surface 216*c* to the second end 216*b*. When the locating block 225*a* is pressed against the guiding surface 216*c*, the shifting plate 225 can be rotated.

Figure 5C:
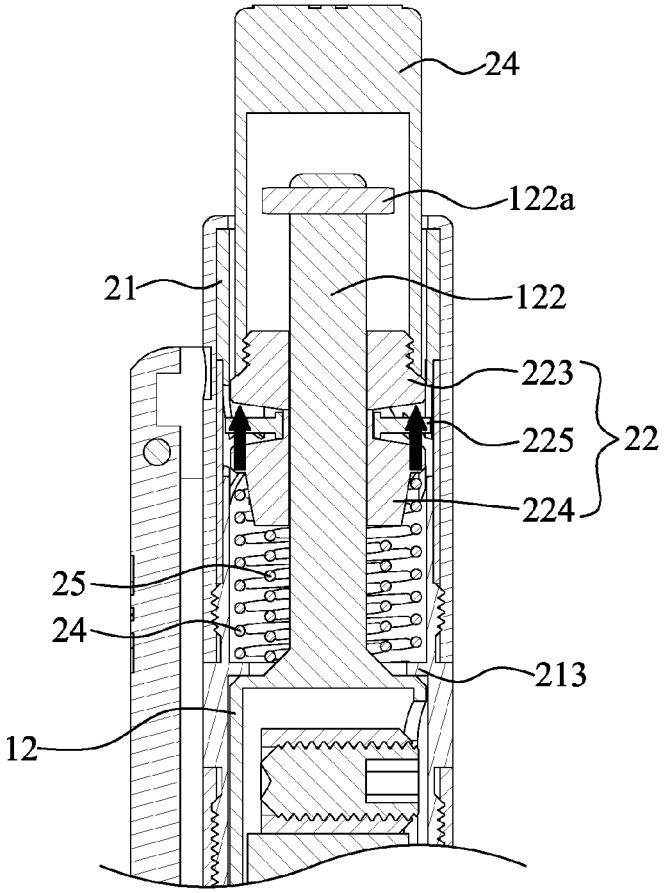
Figure 5D:
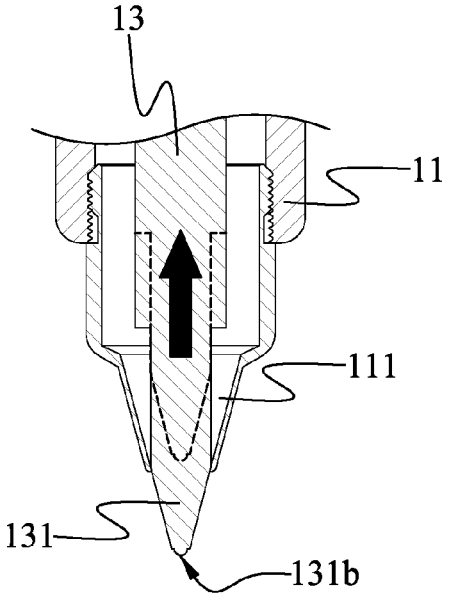
Figure 5E:
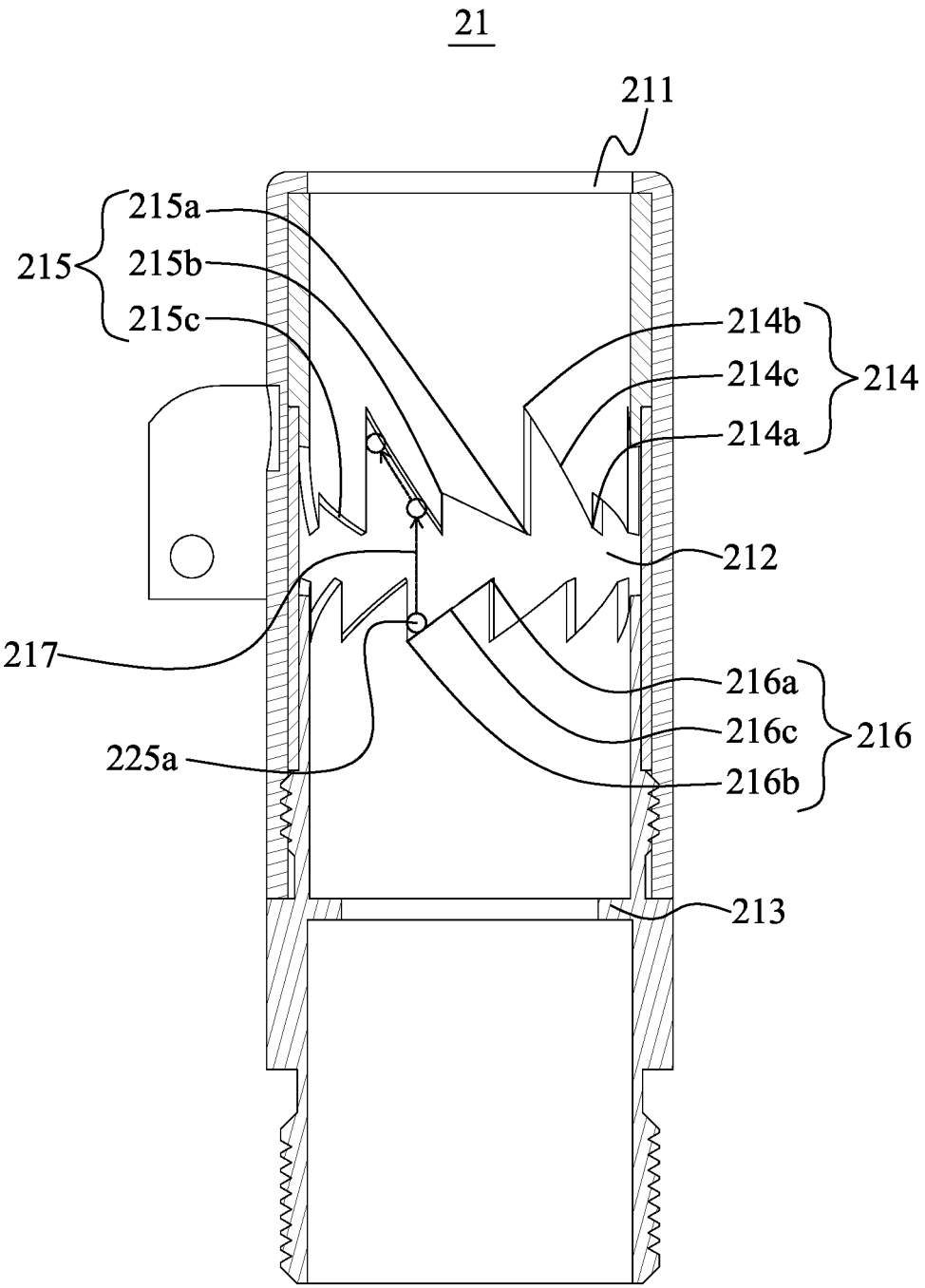

As can be seen in FIGS. 5C to 5E, when the locating block 225*a* is located at the second end 216*b* and the push member 23 is released, the resetting member 24 automatically pushes the shifting member 22 upward, so that the shifting member 22 is moved along the shifting path 217 from the second position 222 up to the first position 221 and the upper slide block 223 is pressed against the abutting section 122*a* of the clamping member 12, bringing the tip 131 to upward move from the extended position 131*b* to the retracted position 131*a*. Meanwhile, the locating block 225*a* is moved from the second end 216*b* of the guiding section 216 to the first contact surface 214*c* of the first locating space 214. Then, the locating block 225*a* is moved along the first contact surface 214*c* toward the first stop point 214*b* and drives the shifting member 22 to move in a circular motion. The locating block 225*a* keeps pressing against the first stop point 214*b* of the first locating space 214 under the elastic restoring force of the resetting member 24. With the locating block 225*a* being continuously pressed against the first stop point 214*b* of the first locating space 214, the tip 131 is continuously held to the retracted position 131*a*, allowing convenient storage of the retractable pen 1 and preventing the tip 131 from scratching paper or the user's cloth.

Figure 6:
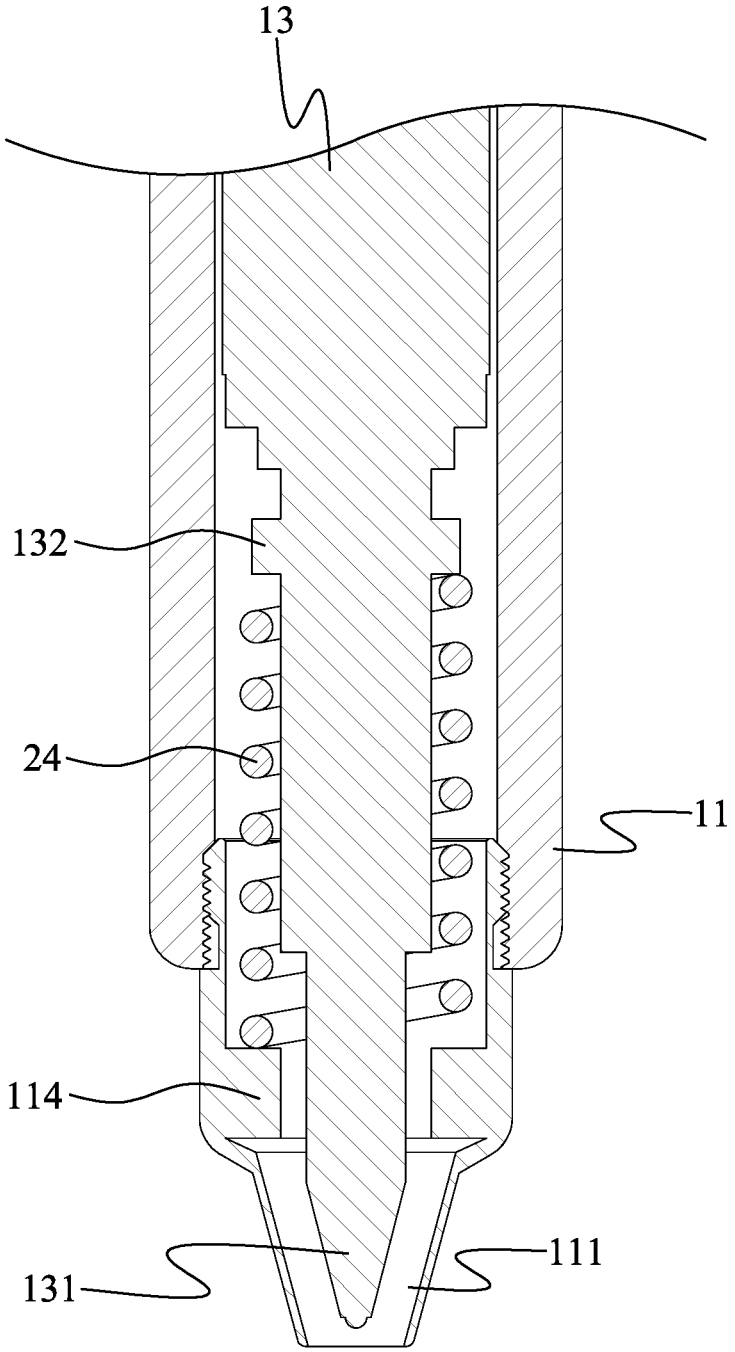
FIG. 6 is a fragmentary, longitudinal sectional view of a retractable pen according to a second preferred embodiment of the present invention.

FIG. 6 is a fragmentary, longitudinal sectional view of a retractable pen according to a second preferred embodiment of the present invention. The second preferred embodiment is different from the first one in the configuration of the body 10 of the retractable pen and the mounting position of the resetting member 24. The structural parts of the second preferred embodiment that are the same as the first preferred embodiment are not repeatedly described herein. In the second preferred embodiment, the ink cartridge 13 includes a compression flange 132 that is radially outward extended from an outer peripheral surface of the ink cartridge 13 into the receiving space 113 in the barrel 11, and the lead-out opening 111 is internally formed with a plurality of circumferentially spaced compression bosses 114; and the resetting member 24 is located in the receiving space 113 of the barrel 11 with an upper end pressing against the compression flange 132 and a lower end pressing against the compression bosses 114. As shown in FIG. 6, when the tip 131 of the ink cartridge 13 is moved from the retracted position 131*a* to the extended position 131*b*, the compression flange 132 and the compression bosses 114 together compress the resetting member 24 between them, so that a distance between the two ends of the resetting member 24 is shortened.

Figure 7:
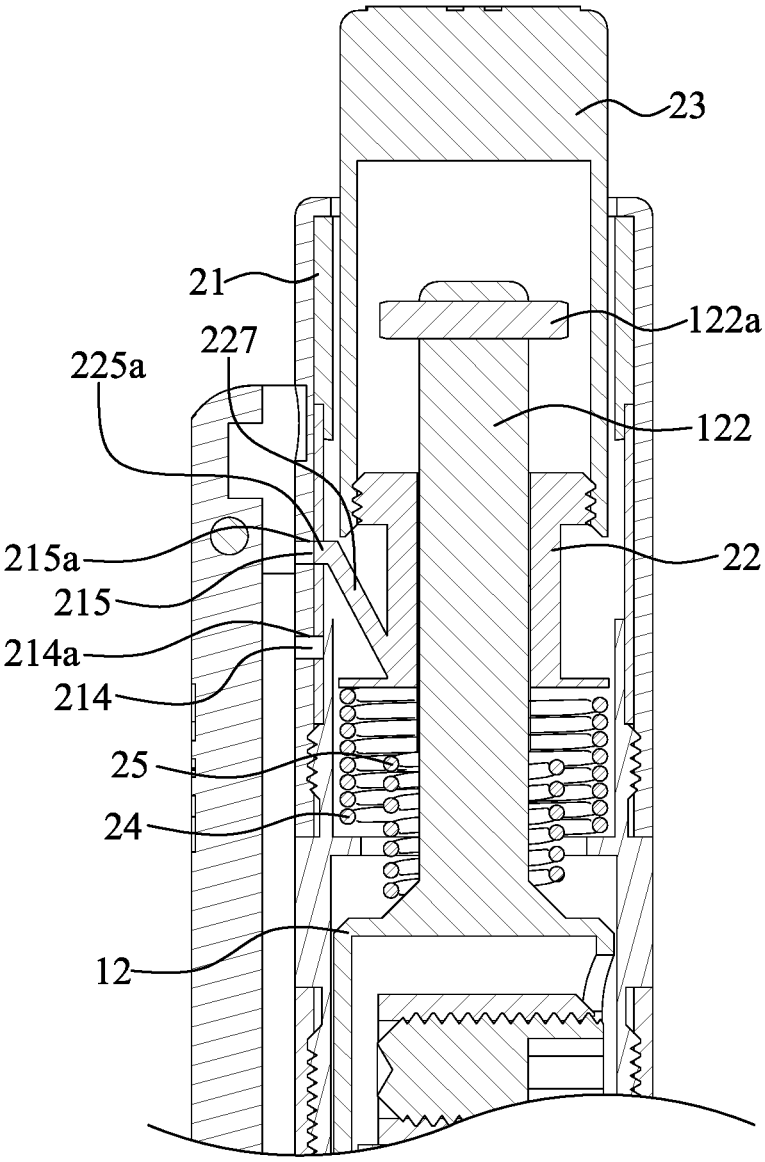
FIG. 7 is a fragmentary, longitudinal sectional view of a retractable pen according to a third preferred embodiment of the present invention.

FIG. 7 is a fragmentary, longitudinal sectional view of a retractable pen according to a third preferred embodiment of the present invention. The third preferred embodiment has a limiting member 21 and a shifting member 22 that are structurally different from those in the first preferred embodiment. Since the body 10, the resetting member 24 and the deformable member 25 in the third preferred embodiment are the same as those in the first preferred embodiment, they are not repeatedly described herein. According to the third preferred embodiment, the limiting member 21 is provided with only the first locating spaces 214 and the second locating spaces 215, the shifting path 217 is a straight line, and the first locating spaces 214 are located immediately above the second locating spaces 215.

In the third preferred embodiment, the shifting member 22 further includes an elastic arm 227 connected to the locating block 225*a*. When the retractable pen according to the third preferred embodiment is in use, the shifting member 22 is initially located at the first position 221. At this point, the locating block 225*a* connected to the elastic arm 227 is directly pressed against the first stop point 214*b* of the first locating space 214. When the shifting member 22 is being moved from the first location 221 toward the second position 222, the locating block 225*a* is initially pressed against the first guide-in point 214*a* and then brought by the elastic arm 227 to move away from the first locating space 214. When the shifting member 22 has been moved to the second position 222, the locating block 225*a* connected to the elastic arm 227 is pressed against the second stop point 215*b* of the second locating space 215, so that the tip 131 is continuously held to the extended position 131*b*.

Figure 8:
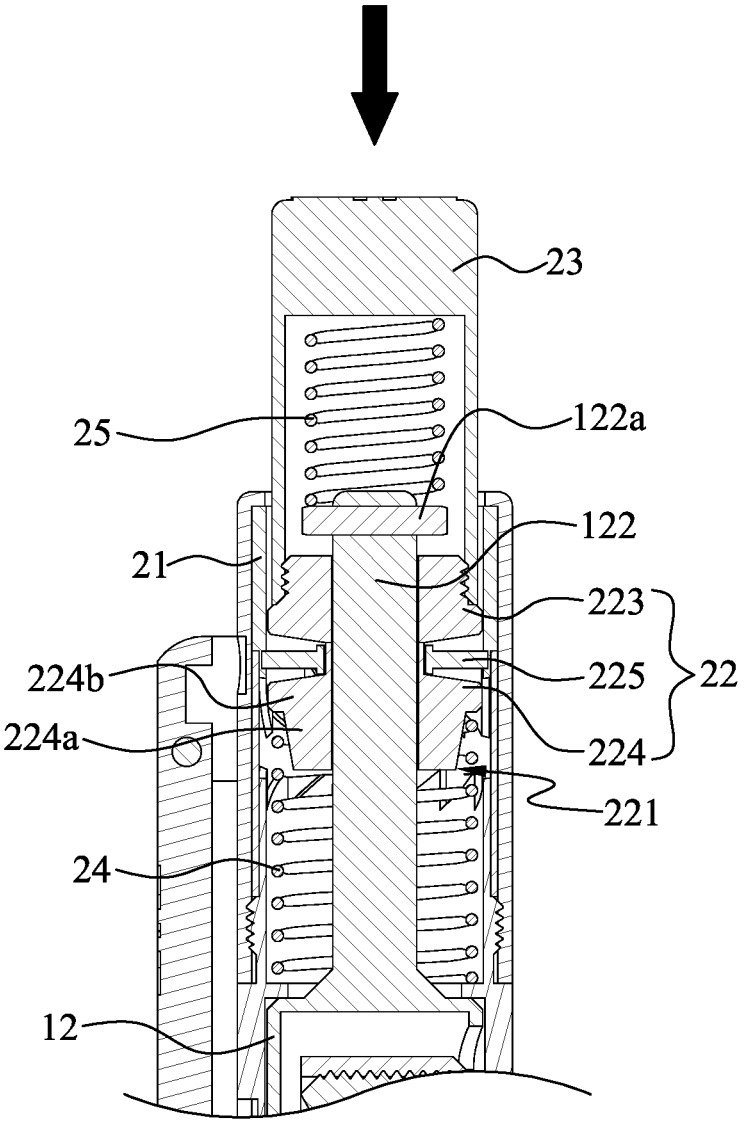
FIG. 8 is a fragmentary, longitudinal sectional view of a retractable pen according to a fourth preferred embodiment of the present invention.

FIG. 8 is a fragmentary, longitudinal sectional view of a retractable pen according to a fourth preferred embodiment of the present invention. The fourth preferred embodiment is generally structurally similar to the first preferred embodiment but has a deformable member 25 mounted on a top of the assembling stem 122 of the clamping member 12 instead of being fitted around the assembling stem 122. As shown in FIG. 8, the deformable member 25 has a lower end pressed against the abutting section 122*a* of the clamping member 12 and an upper end pressed against the push member 23. When the tip 131 is located at the extended position 131*b*, the deformable member 25 is compressed by between the abutting section 122*a* and the push member 23 and the shifting member 22 is driven by the push member 23 to move to the second position 222.

Figure 9:
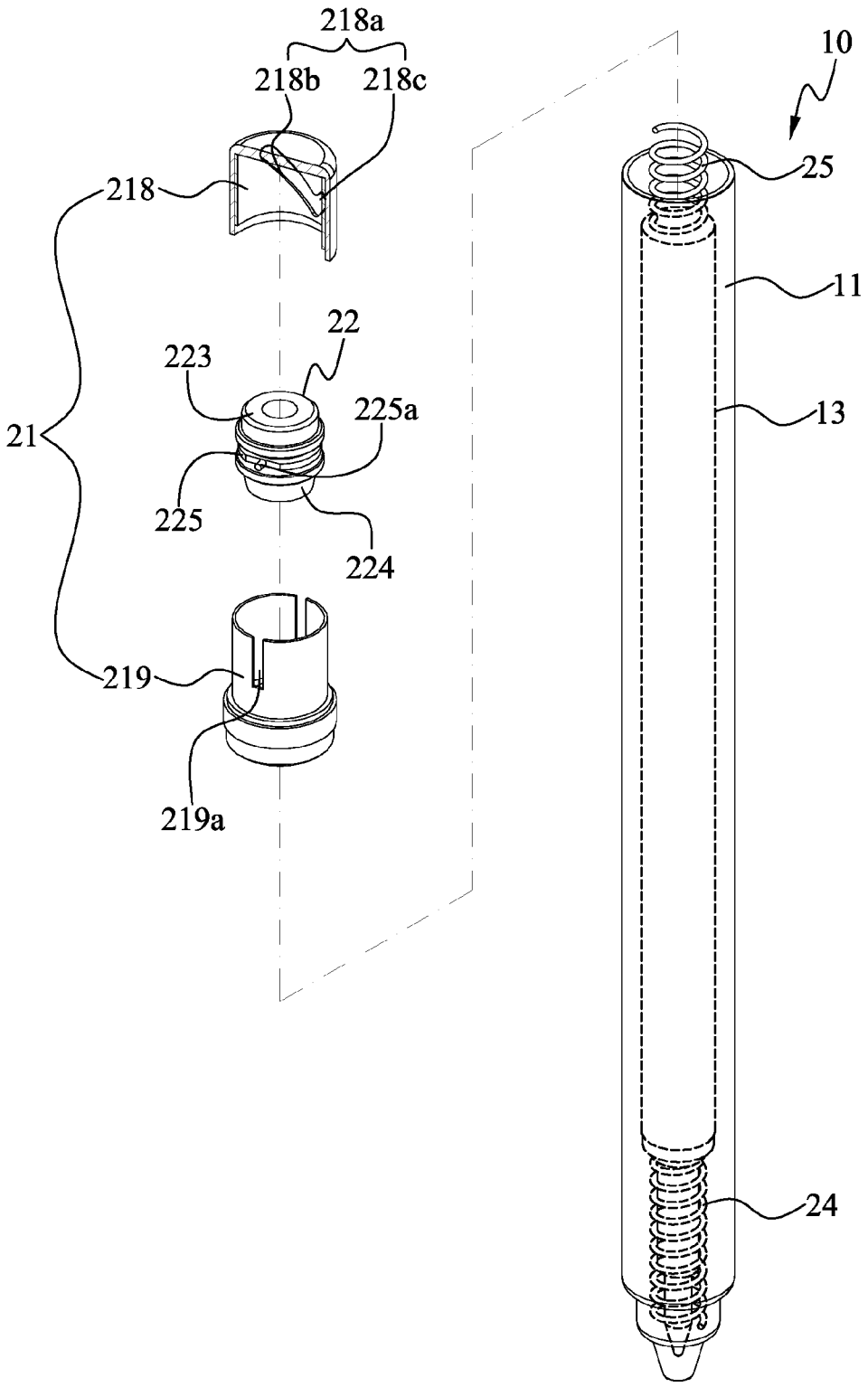
FIG. 9 is an exploded, partially cutaway and partially phantom view of a retractable pen according to a fifth preferred embodiment of the present invention.
Figure 10:
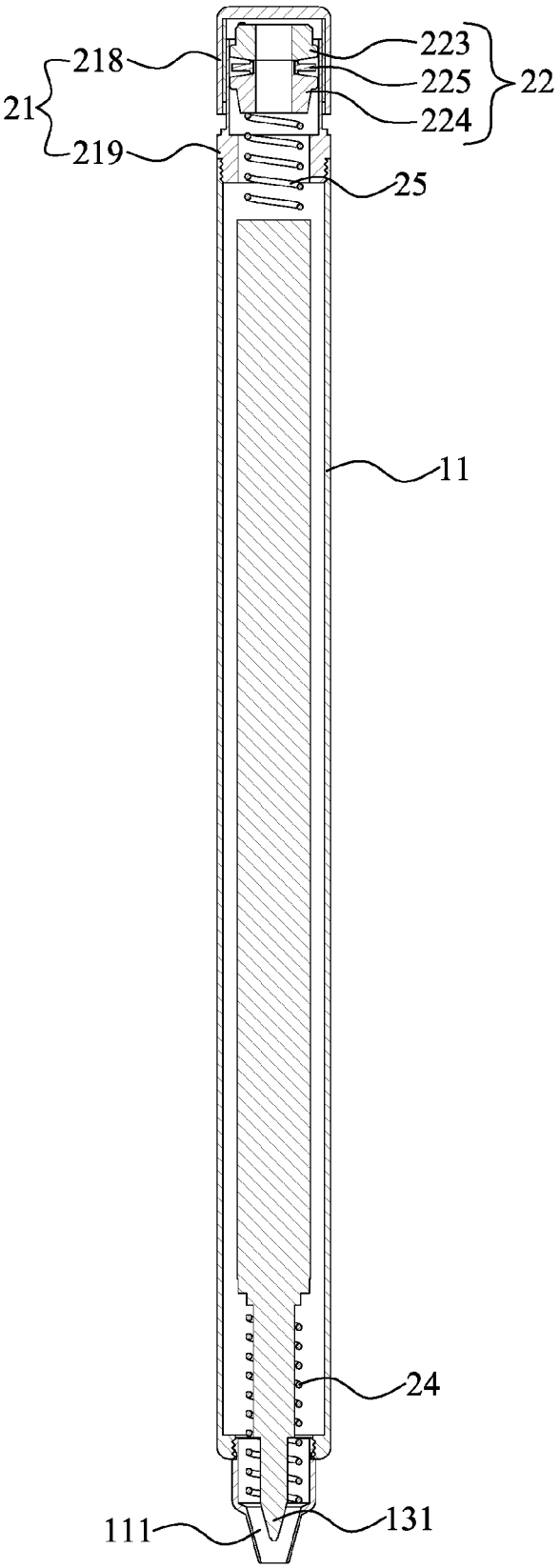
FIG. 10 is an assembled longitudinal sectional view of the retractable pen of FIG. 9.

FIGS. 9 and 10 are exploded perspective and assembled sectional views, respectively, of a retractable pen according to a fifth preferred embodiment of the present invention. The fifth preferred embodiment is different from the second preferred embodiment in the switching device 20. In the fifth preferred embodiment, the switching device 20 includes a limiting member 21, a shifting member 22, a resetting member 24 and a deformable member 25. Since all other structures of the fifth preferred embodiment are similar to the second preferred embodiment, they are not repeated described herein. As shown, in the fifth preferred embodiment, the limiting member 21 includes a rotational housing 218 and a stationary housing 219. The rotational housing 218 is rotatably connected to the stationary housing 219 and has a first limiting rail 218*a* corresponding to the shifting path 217. The stationary housing 219 is fixedly connected to the lead-in opening 112 of the barrel 11 and is formed with a straight second limiting rail 219*a*. The second limiting rail 219*a* intersects with the first limiting rail 218*a*.

The first limiting rail 218*a* includes two lateral portions, one of which is defined as a first rail section 218*b* while the other one of which is defined as a second rail section 218*c*. The first and the second rail section 218*b*, 218*c* are obliquely extended in two different directions, giving the first limiting rail 218*a* a substantially V-shaped configuration. Further, the locating block 225*a* of the shifting member 22 is extended through the second limiting rail 219*a* into the first limiting rail 218*a*.

Figure 11A:
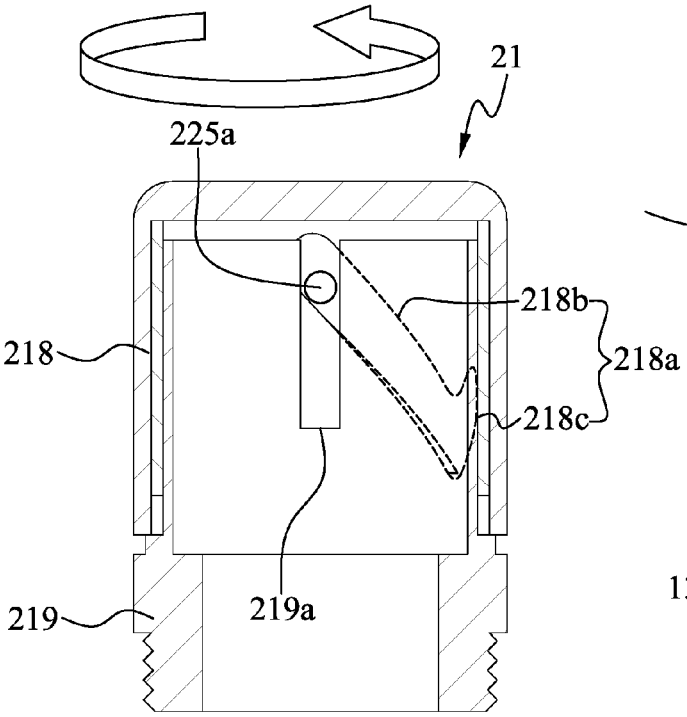
FIGS. 11A to 11C are sectional views showing a tip of the retractable pen of FIG. 9 is shifted from a retracted position to an extended position.
Figure 11B:
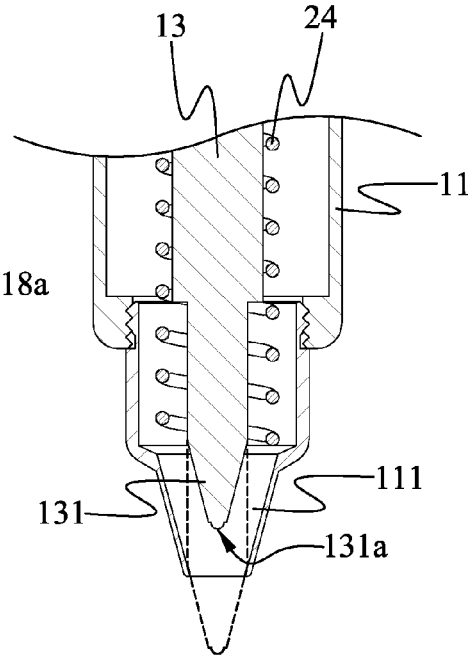

Referring to FIGS. 11A and 11B. To use the retractable pen according to the fifth preferred embodiment of the present invention, first turn the rotational housing 218 counterclockwise to change the position of the first limiting rail 218*a* relative to the second limiting rail 219*a*. At this point, the shifting member 22 is brought to move downward along the first limiting rail 218*a* from the first position 221, and the tip 131 is accordingly moved from the retracted position 131*a* to the extended position 131*b*. Meanwhile, with the locating block 225*a* being extended into the first limiting rail 218*a* to press against a wall surface of the first limiting rail 218*a*, the shifting member 22 can be moved in a circular motion.

Figure 11C:
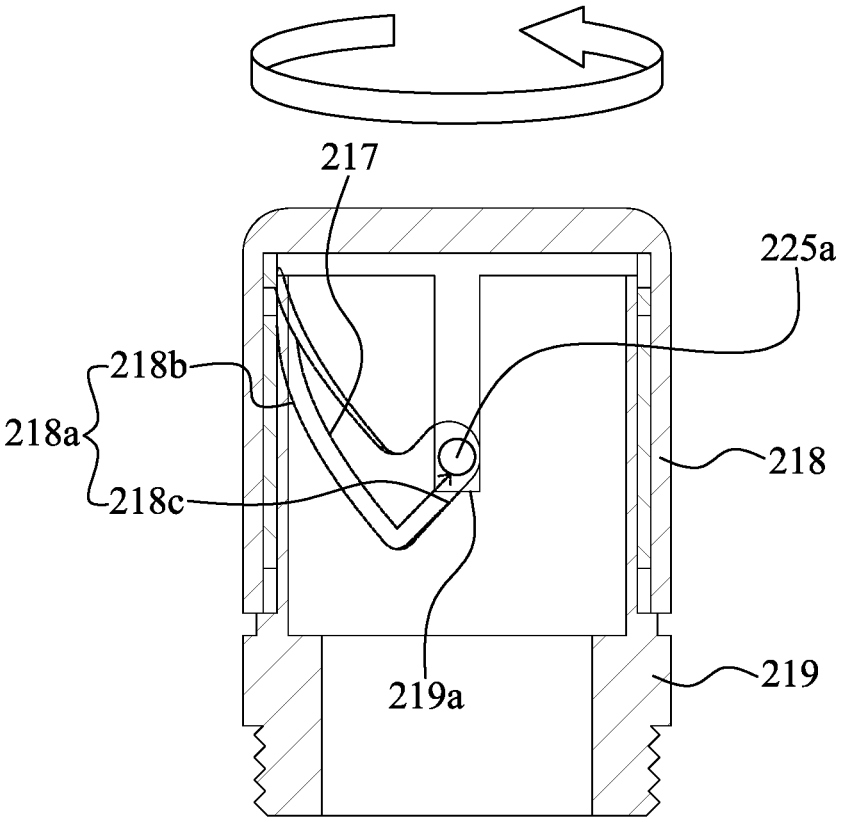

Referring to FIG. 11C. When the tip 131 is located at the extended position 131*b*, the shifting member 22 is located at the third position 226. While the tip 131 is pressed against the lead-out opening 111 and can not be moved downward any further, the deformable member 25 located between the shifting member 22 and the ink cartridge 13 can be compressed. Therefore, the rotational housing 218 can still be further turned counterclockwise and the shifting member 22 can still be moved along the first limiting rail 218*a* to the second position 222.

In the course of moving toward the second position 222, the shifting member 22 will pass a joint of the first rail section 218*b* and the second rail section 218*c* and then keeps moving along the second rail section 218*c* to the second stop point 215*b*. With the locating block 225*a* of the shifting member 22 being located at the second stop point 215*b*, the tip 131 is continuously held to the extended position 131*b*. Since the first rail section 218*b* and the second rail section 218*c* are obliquely extended in two different directions and the locating block 225*a* is sequentially pressed against the first rail section 218*b* and the second rail section 218*c* while moving, the shifting member 22 is moved to the second position 222 in two shifting directions.

Figure 12A:
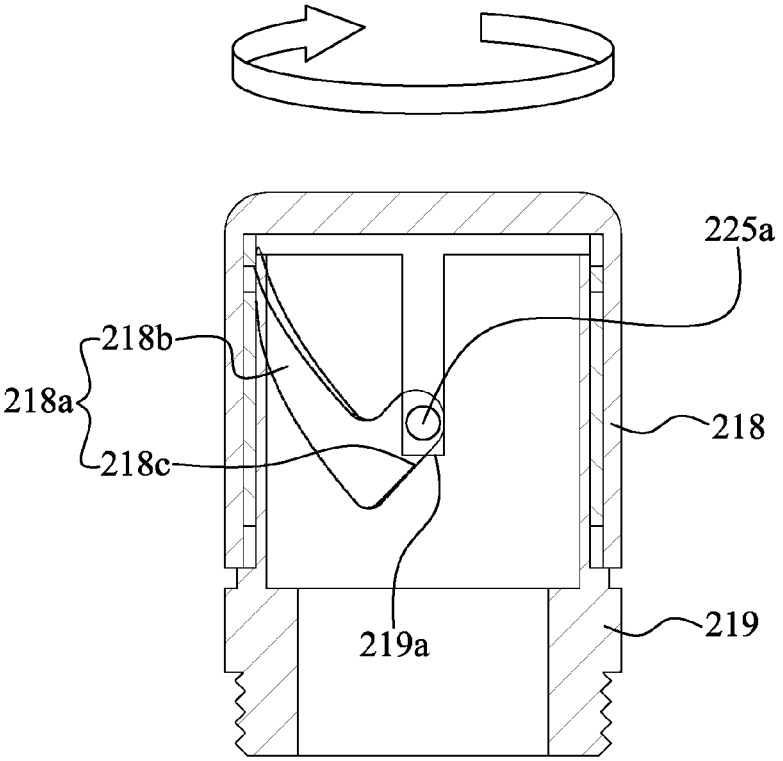
FIGS. 12A to 12C are sectional views showing the tip of the retractable pen of FIG. 9 is shifted from the extended position to the retracted position.
Figure 12B:
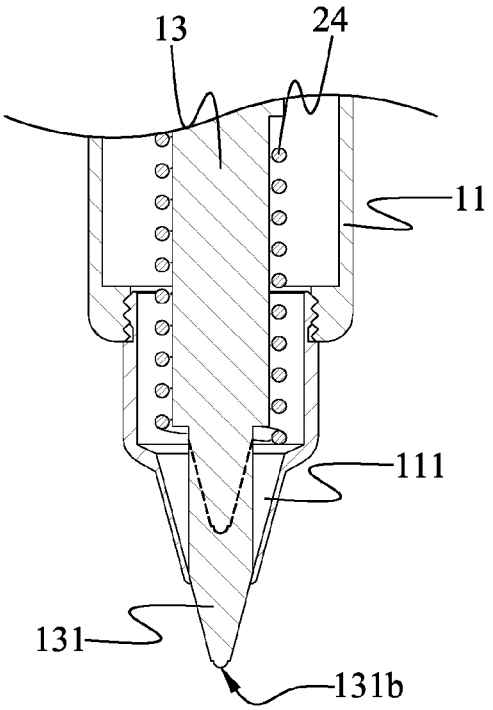
Figure 12C:
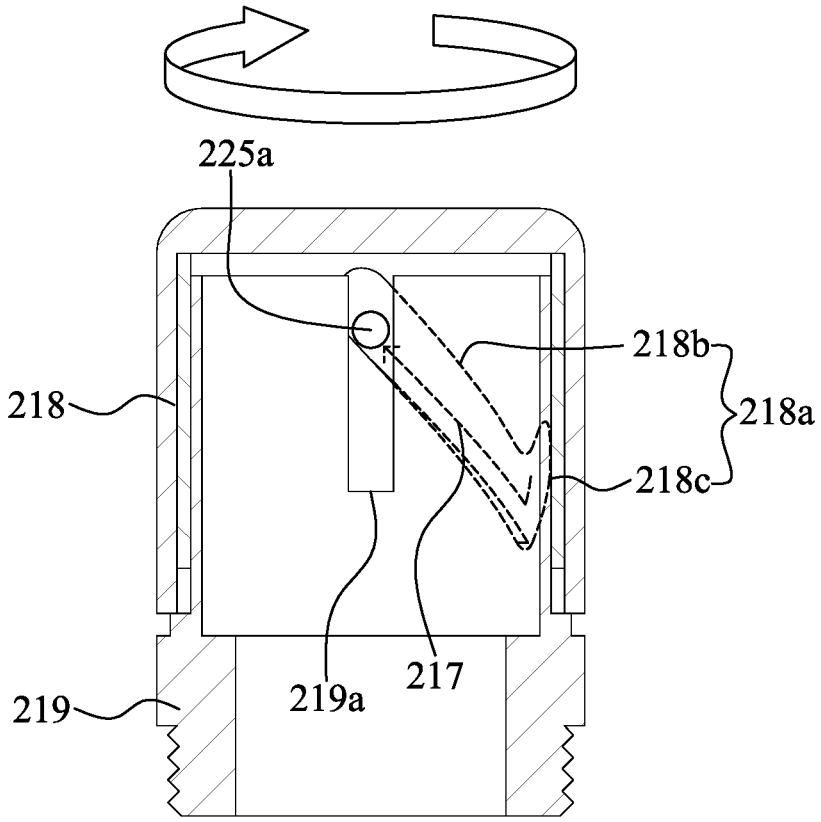

Referring to FIGS. 12A to 12C. When the user has completed writing with the retractable pen according to the fifth preferred embodiment of the present invention, the user can simply turn the rotational housing 218 clockwise. At this point, the shifting member 22 is brought to upward move from the second position 222 along the first limiting rail 218*a* to the first position 221, and the resetting member 24 automatically pushes the ink cartridge 131 to upward move from the extended position 131*b* to the retracted position 131*a*.

Figure 13:
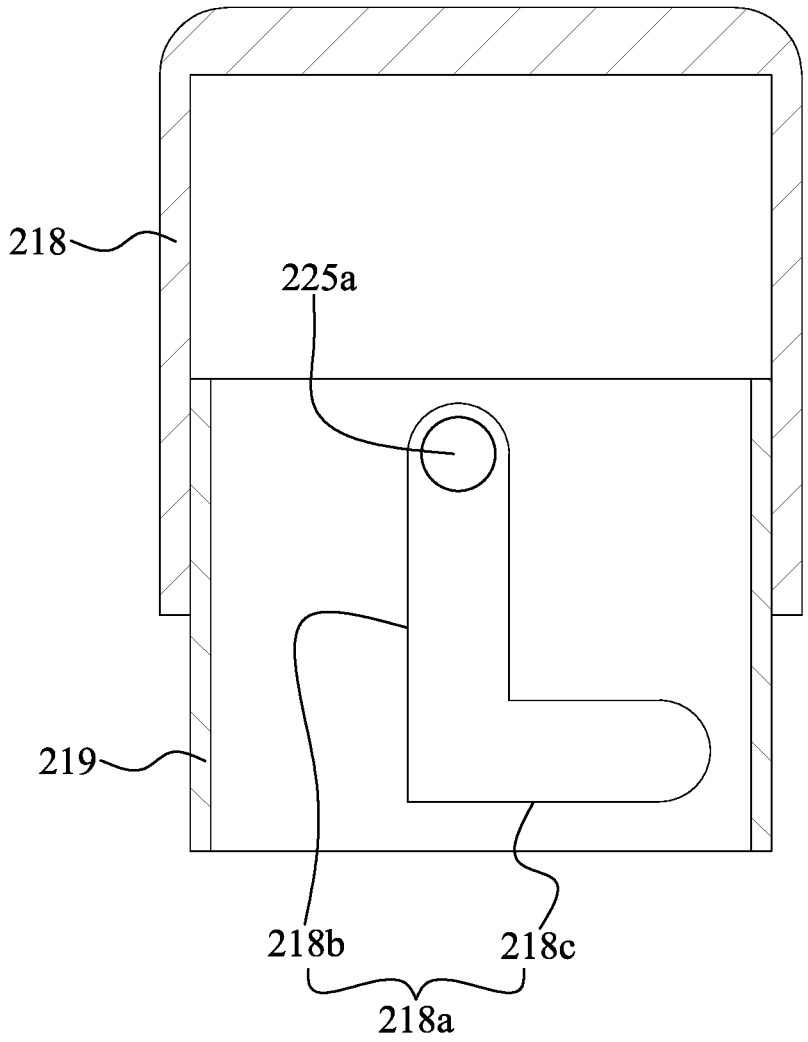
FIG. 13 shows a first limiting rail for a retractable pen according to a sixth preferred embodiment of the present invention.

FIG. 13 shows a first limiting rail for a retractable pen according to a sixth preferred embodiment of the present invention. The sixth preferred embodiment is different from the fifth one in the configuration of the first limiting rail 218*a*. As shown, in the sixth preferred embodiment, the first rail section 218*b* of the first limiting rail 218*a* is longitudinally extended while the second rail section 218*c* is horizontally extended, so that the first and the second rail section 218*b*, 218*c* are perpendicular to each other, giving the first limiting rail 218*a* an L-shaped configuration.

Figure 14A:
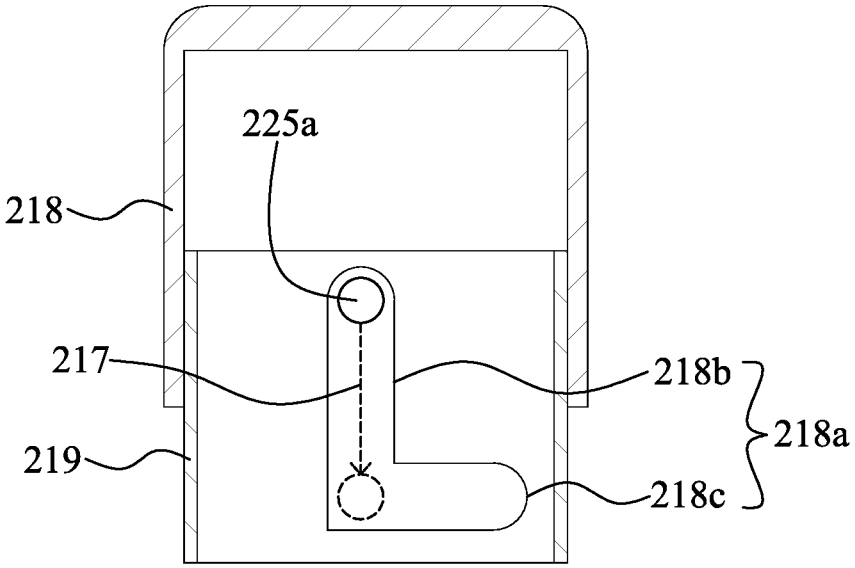
FIGS. 14A and 14B are sectional views showing a shifting member of the retractable pen according to the sixth preferred embodiment of the present invention is shifted along the first limiting rail.
Figure 14B:
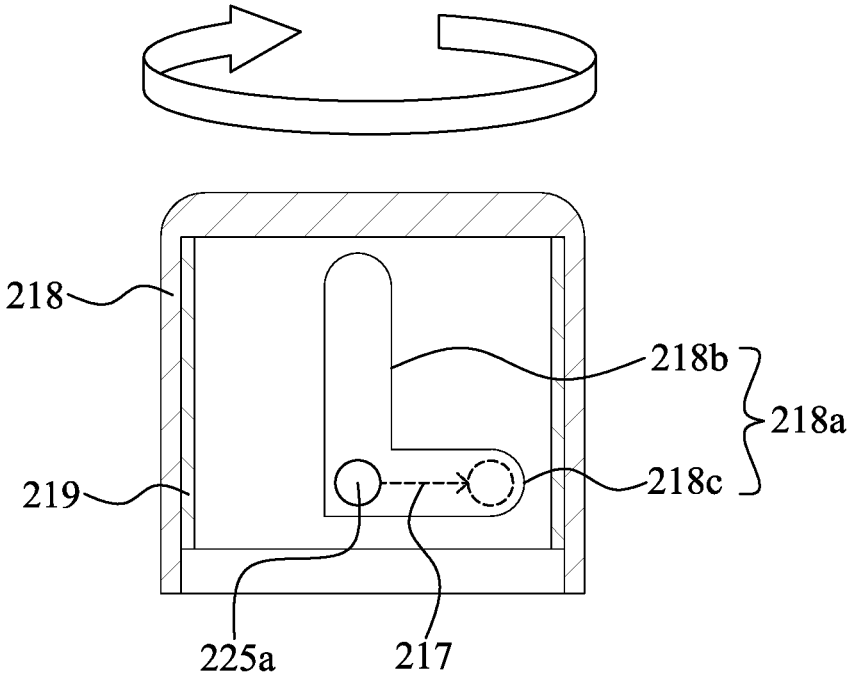

Referring to FIGS. 14A and 14B. According to the sixth preferred embodiment, when the shifting member 22 is moved from the first position 221 toward the second position 222, it is first moved along the first rail section 218*b* in a linear motion and then the rotational housing 218 is turned for the locating block 225*a* to move into the second rail section 218*c*.

Figure 15:
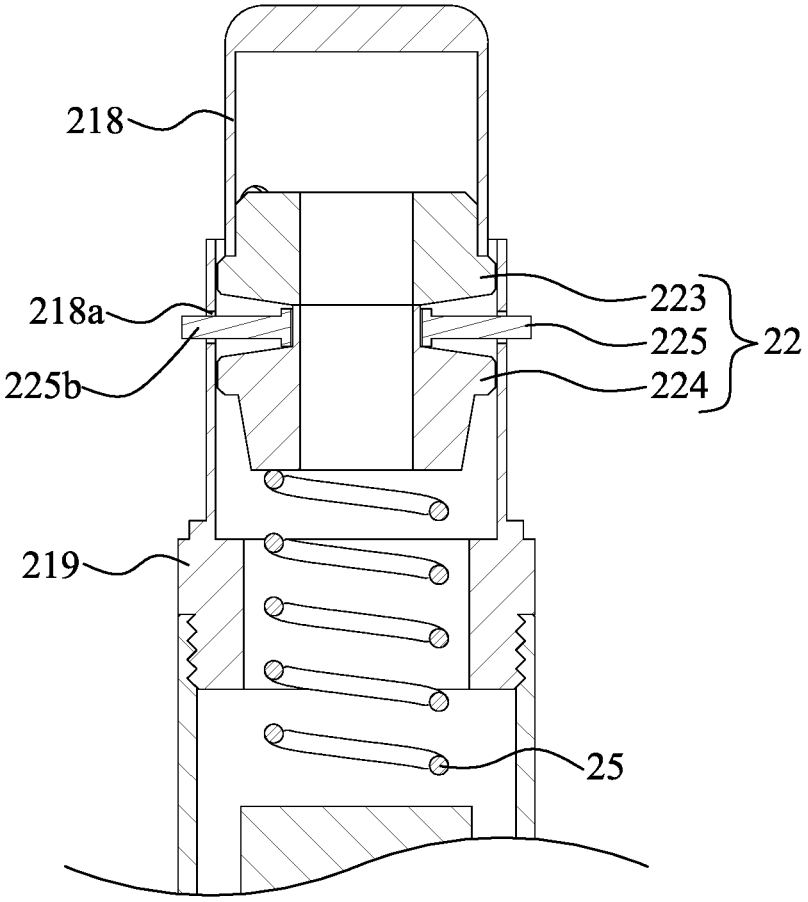
FIG. 15 is a fragmentary, longitudinal sectional view of a retractable pen according to a seventh preferred embodiment of the present invention.

FIG. 15 is a fragmentary, longitudinal sectional view of a retractable pen according to a seventh preferred embodiment of the present invention. As shown, the seventh preferred embodiment is different from the fifth one in the limiting member 21 and the shifting member 22. According to the seventh preferred embodiment, while the limiting member 21 includes the rotational housing 218 and the stationary housing 219, just the same as the fifth preferred embodiment, the rotational housing 218 is used to rotate the shifting member 22, the first limiting rail 218*a* is formed on the stationary housing 219 and the locating block 225*a* of the shifting member 22 is extended through the first limiting rail 218*a* to project from the stationary housing 219 and form a projected section 225*b*.

To use the retractable pen according to the seventh preferred embodiment, simply turn the rotational housing 218 counterclockwise for the shifting member 22 to move from the first position 221 along the first limiting rail 218*a* to the second position 222. At this point, the locating block 225*a* is pressed against the second stop point 215*b* and the tip 131 is continuously held to the extended position 131*b*. It is understood the above description of turning the rotational housing 218 to move the shifting member 22 to the second position 222 is only illustrative to facilitate easy explanation of the present invention. That is, in practical use of the retractable pen, the user may also move the shifting member 22 to the second position 222 by operating the projected section 225*b*.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A retractable pen, comprising:

a body including a barrel and an ink cartridge received in the barrel; the barrel having a lower end forming a lead-out opening, and the ink cartridge having a tip formed at a lower end thereof; and a switching device mounted between the barrel and the ink cartridge for causing the tip to move between an extended position, in which the tip is projected from the lead-out opening of the barrel, and a retracted position, in which the tip is located in the barrel;

the lead-out opening of the barrel having an inner diameter smaller than an outer diameter of the tip, such that the tip moved to the extended position is pressed against and immovably held to the lead-out opening; and the switching device including:

a limiting member fitted in the barrel and formed with a plurality of first stop points for limiting the tip to the retracted position continuously and a plurality of second stop points for limiting the tip to the extended position continuously; and a shifting path being defined between any two adjacent first and second stop points;

a shifting member mounted in the limiting member and movable from one first stop point to an adjacent second stop point or from one second stop point to an adjacent first stop point, such that the shifting member can be shifted along the shifting path between a first position farther away from an upper end of the ink cartridge and a second position closer to the upper end of the ink cartridge for pushing against the ink cartridge;

a deformable member mounted between the shifting member and the ink cartridge; wherein when the tip is located at the extended position and the shifting member is located at a third position within the shifting path before being moved to the second position, the deformable member can be compressed and deformed by between the shifting member and the ink cartridge, allowing the shifting member to be further moved from the third position to the second position; and a resetting member for elastically bringing the tip from the extended position to the retracted position.

2. The retractable pen as claimed in claim 1, wherein the shifting member having been moved along the shifting path to the second position is movable from the second position back to the first position by an elastic restoring force of the resetting member, so as to press against the first stop point or the second stop point.

3. The retractable pen as claimed in claim 2, wherein the limiting member is internally formed with a radially inward extended abutting seat; and the resetting member having an end pressing against the abutting seat and another end pressing against the shifting member.

4. The retractable pen as claimed in claim 2, wherein the ink cartridge is formed with a radially outward extended compression flange and the barrel is formed in the lead-out opening with a plurality of circumferentially spaced compression bosses; and the resetting member having an end pressing against the compression flange and another end pressing against the compression bosses.

5. The retractable pen as claimed in claim 1, wherein the shifting member located at the first position is pressed against the first stop point or the second stop point.

6. The retractable pen as claimed in claim 1, wherein the deformable member compressed by between the ink cartridge and the shifting member is shortened by a compression length; and the compression length being equal to a longitudinal straight-line distance from the third position to the second position; and wherein a straight-line distance by which the tip is moved from the retracted position to the extended position is equal to a longitudinal straight-line distance from the first position to the third position.

7. The retractable pen as claimed in claim 1, wherein the shifting member located at the third position has a height position higher than or the same as that of the second stop points.

8. The retractable pen as claimed in claim 1, wherein the limiting member further includes a first guide-in point located below each of the first stop points and a second guide-in point located below each of the second stop points; and the shifting member located at the third position having a height position higher than both of the first guide-in points and the second guide-in points.

9. The retractable pen as claimed in claim 8, wherein the limiting member further includes a first contact surface located between each of the first stop points and its corresponding first guide-in point, and the shifting member being moved from the first guide-in point to the first stop point via the first contact surface; and wherein the limiting member further includes a second contact surface located between each of the second stop points and its corresponding second guide-in point, and the shifting member being moved from the second guide-in point to the second stop point via the second contact surface; the first contact surfaces and the second contact surfaces being extended in two nonparallel directions; an included angle between each of the first contact surfaces and a horizontal plane being a blunt angle; and an included angle between each of the second contact surfaces and the horizontal plane also being a blunt angle.

10. The retractable pen as claimed in claim 9, wherein the limiting member further includes a plurality of guide sections correspondingly located below the first guide-in points and the second guide-in points, such that the shifting member is moved from one first stop point to an adjacent second stop point or from one second stop point to an adjacent first stop point via one corresponding guide section; each of the guide sections including a first end and an opposite second end located at a horizontal height lower than that of the first end; and one of two adjacent first and second ends being longitudinally located corresponding to one first contact surface while the other one of the two adjacent first and second ends being longitudinally located corresponding to one second contact surface located adjacent to that first contact surface.

11. The retractable pen as claimed in claim 10, wherein each of the guide sections further includes a guiding surface extended between the first end and the second end, and the shifting member being moved from the first end to the second end via the guiding surface; the guiding surfaces being extended in a direction nonparallel to the first contact surfaces and the second contact surfaces; and an included angle between each of the guiding surfaces and a horizontal plane being a sharp angle.

12. The retractable pen as claimed in claim 11, wherein the shifting member in the course of moving from the third position to the second position is pressed against the guiding surfaces and moved in a circular motion.

13. The retractable pen as claimed in claim 1, wherein the shifting path is a straight line and the second stop point is located immediately below the corresponding first stop point; and wherein the shifting member includes an elastic arm, which is directly pressed against the second stop point and the first stop point when the shifting member is located at the second position and the first position, respectively.

14. The retractable pen as claimed in claim 1, wherein the limiting member is provided with a first limiting rail corresponding to the shifting path and the shifting member is assembled to the first limiting rail; whereby when the shifting member is moved along the first limiting rail from the second stop point to the first stop point, the shifting member is pressed against a wall surface of the first limiting rail and moved in a circular motion.

15. The retractable pen as claimed in claim 1, wherein the shifting member includes a lower slide block, an upper slide block and a shifting plate located between the lower and the upper slide block, such that the lower slide block and the shifting plate are brought by the upper slide block to move; the lower slide block including a first body portion and a second body portion formed on a top of the first body portion; and the deformable member having an end pressing against the first body portion.

* * * * *